US008276900B2

(12) United States Patent
Watanabe et al.

(10) Patent No.: US 8,276,900 B2
(45) Date of Patent: Oct. 2, 2012

(54) SHEET PROCESSING APPARATUS AND IMAGE FORMING APPARATUS EQUIPPED WITH THE SAME

(75) Inventors: Kiyoshi Watanabe, Matsudo (JP); Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 146 days.

(21) Appl. No.: 12/721,467

(22) Filed: Mar. 10, 2010

(65) Prior Publication Data

US 2010/0230886 A1 Sep. 16, 2010

(30) Foreign Application Priority Data

Mar. 16, 2009 (JP) ..... 2009-063013
Sep. 8, 2009 (JP) ..... 2009-207096

(51) Int. Cl.
*B31F 1/10* (2006.01)

(52) U.S. Cl. ..... 270/45; 270/32; 270/51; 270/58.07

(58) Field of Classification Search ..... 270/32, 270/45, 51, 58.07; 412/22
See application file for complete search history.

(56) References Cited

U.S. PATENT DOCUMENTS

| | | | | |
|---|---|---|---|---|
| 6,692,208 | B1 | 2/2004 | Watkiss | |
| 7,147,598 | B2 * | 12/2006 | Fujimoto et al. | 493/405 |
| 7,325,799 | B2 * | 2/2008 | Watkiss | 270/39.08 |
| 7,594,645 | B2 * | 9/2009 | Suzuki et al. | 270/37 |
| 2005/0189688 | A1 * | 9/2005 | Suzuki et al. | 270/32 |
| 2008/0315488 | A1 * | 12/2008 | Iguchi et al. | 270/37 |

FOREIGN PATENT DOCUMENTS

JP 2007-144679 A 6/2007

* cited by examiner

*Primary Examiner* — Leslie A Nicholson, III
(74) *Attorney, Agent, or Firm* — Canon USA Inc IP Division

(57) ABSTRACT

A folded spine of a booklet held by a pair of opposing holding members is deformed by entering a pressing member into a gap between the pair of holding members and bringing the pressing member into pressure contact with the folded spine. In consequence, the folded spine is prevented from receiving an excessive pressing force, and a smooth surface with a width substantially equal to the thickness of the booklet is thus formed on the folded spine, whereby a booklet with a good appearance can be made.

17 Claims, 23 Drawing Sheets

| FIG. 14A |
| --- |
| FIG. 14B |

SHEET PROCESSING APPARATUS AND IMAGE FORMING APPARATUS EQUIPPED WITH THE SAME

BACKGROUND OF THE INVENTION

1. Field of the Invention

The present invention relates to sheet processing apparatuses that perform processing on sheet bundles, and particularly, to a sheet processing apparatus that deforms a folded spine of a booklet, which is made by folding a predetermined number of stacked sheets, so as to enhance stackability and to improve the appearance of the booklet.

2. Description of the Related Art

Generally, when a bundle of 20 or more stacked sheets is folded, a booklet with a curved finish at the folded section is often made. Because such a booklet is insufficiently folded, the open side thereof opposite the folded section tends to open undesirably, resulting in a poor external appearance.

In order to solve this problem, a method and an apparatus for squaring the spine of the folded section (folded spine or back) of such a booklet as an example of a deformation process are provided (see U.S. Pat. No. 6,692,208). By performing such a deformation process on the folded spine of the booklet, the booklet can be tightly folded, making the open side of the booklet less likely to open undesirably and thus providing a booklet with a good appearance.

The configuration of a sheet processing apparatus of related art will be described with reference to FIGS. 17A to 19.

FIG. 17A schematically illustrates a traveling direction of a pressing roller 704 that comes into pressure contact with a folded spine of a booklet so as to deform the folded spine. The pressing roller 704 is located at a receded position in an area where it does not come into contact with a booklet until the booklet is nipped by gripping portions 702 and 703. When the gripping portions 702 and 703 nip and secure the booklet, the pressing roller 704 moves from one end to another end along the folded spine of the booklet while applying pressure to the folded section.

First, as shown in FIG. 17B, a booklet 701 is conveyed by conveying portions 706 and 707 while the folded spine of the booklet 701 acts as the leading edge. The booklet 701 is positioned by bringing the folded spine into abutment with a positioning portion 705. Subsequently, as shown in FIG. 17C, the booklet is gripped by the gripping portions 702 and 703 in a state such that the folded spine protrudes therefrom, and then the positioning portion 705 is moved away from the folded spine. Then, the pressing roller 704 moves while applying pressure to the folded spine of the booklet protruding from the gripping portions 702 and 703. The reason that the folded spine of the booklet 701 gripped by the gripping portions 702 and 703 is made to protrude therefrom is to deform the protruding folded spine by bringing the pressing roller 704 into pressure contact with the folded spine. If the protruding amount from the gripping portions 702 and 703 is too small, the folded spine becomes less deformable since the stiffness thereof increases. If the protruding amount is too large, the folded spine also becomes less deformable since it escapes from the pressing roller 704 during the deformation process. Therefore, the protruding amount is set to an appropriate value.

The term "squaring" refers to a process of angularly deforming the folded spine having a curved shape. FIG. 17D illustrates a state where the booklet having undergone a squaring (deformation) process is being ejected onto a paper output tray 708. FIG. 18A schematically illustrates the folded spine of the booklet when the folded spine is being pressed and squared.

However, because the folded spine of the booklet protruding from the gripping portions 702 and 703 is pressed, edges 709*a* and 709*b* of the squared folded spine protrude outward in the thickness direction, as shown in FIG. 18B, resulting in a deteriorated appearance. Furthermore, when the pressing roller 704 is brought into pressure contact with the folded spine, the folded spine deformed outward in the thickness direction may strongly abut on edges 702*a* and 703*a* of the gripping portions 702 and 703 gripping the booklet, leaving pressing marks on the booklet.

FIG. 19 illustrates the folded section of the booklet having undergone the aforementioned process in a state where the folded section protrudes from the gripping portions 702 and 703. The folded spine protruding from the gripping portions 702 and 703 deforms outward in the thickness direction of the booklet along a pressing surface of the pressing roller 704. The width of the squared folded spine is greater than the thickness of the actual booklet, resulting in reduced stackability of booklets.

Since the entire folded spine of the booklet protruding from the gripping portions 702 and 703 is subjected to the deformation process, a folded spine 709*c* of sheets in the central section of the booklet, which do not need to be squared, becomes undesirably deformed if the folded spine 709*c* protrudes from the gripping portions 702 and 703.

In the present invention, the folded spine can be deformed (squared) into a shape that exhibits a good appearance.

SUMMARY OF THE INVENTION

The present invention provides a sheet processing apparatus that includes a holding unit that holds a booklet made of a folded sheet, the holding unit having a pair of opposing holding members that nips the booklet, and a pressing member that comes into pressure contact with a folded spine of the booklet held by the holding unit so as to deform the folded spine. The pressing member deforms the folded spine of the booklet by entering into a gap between the pair of holding members and coming into pressure contact with the folded spine. The pair of holding members includes a regulating portion that regulates the folded spine of the booklet so that the folded spine of the booklet to be deformed by the pressing member is prevented from deforming to a thickness that exceeds a thickness of the booklet nipped and held by the pair of holding members.

According to the present invention, since the pressing member enters into the gap between the pair of holding members holding the booklet so as to come into pressure contact with the folded spine, the folded spine can be deformed into a shape that exhibits a good appearance, and good stackability can be ensured since deformation of the folded spine in the thickness direction is minimized.

Further features of the present invention will become apparent from the following description of exemplary embodiments with reference to the attached drawings.

DESCRIPTION OF THE EMBODIMENTS

Embodiments of the present invention will be described in detail below with reference to the drawings.

Figure 1:
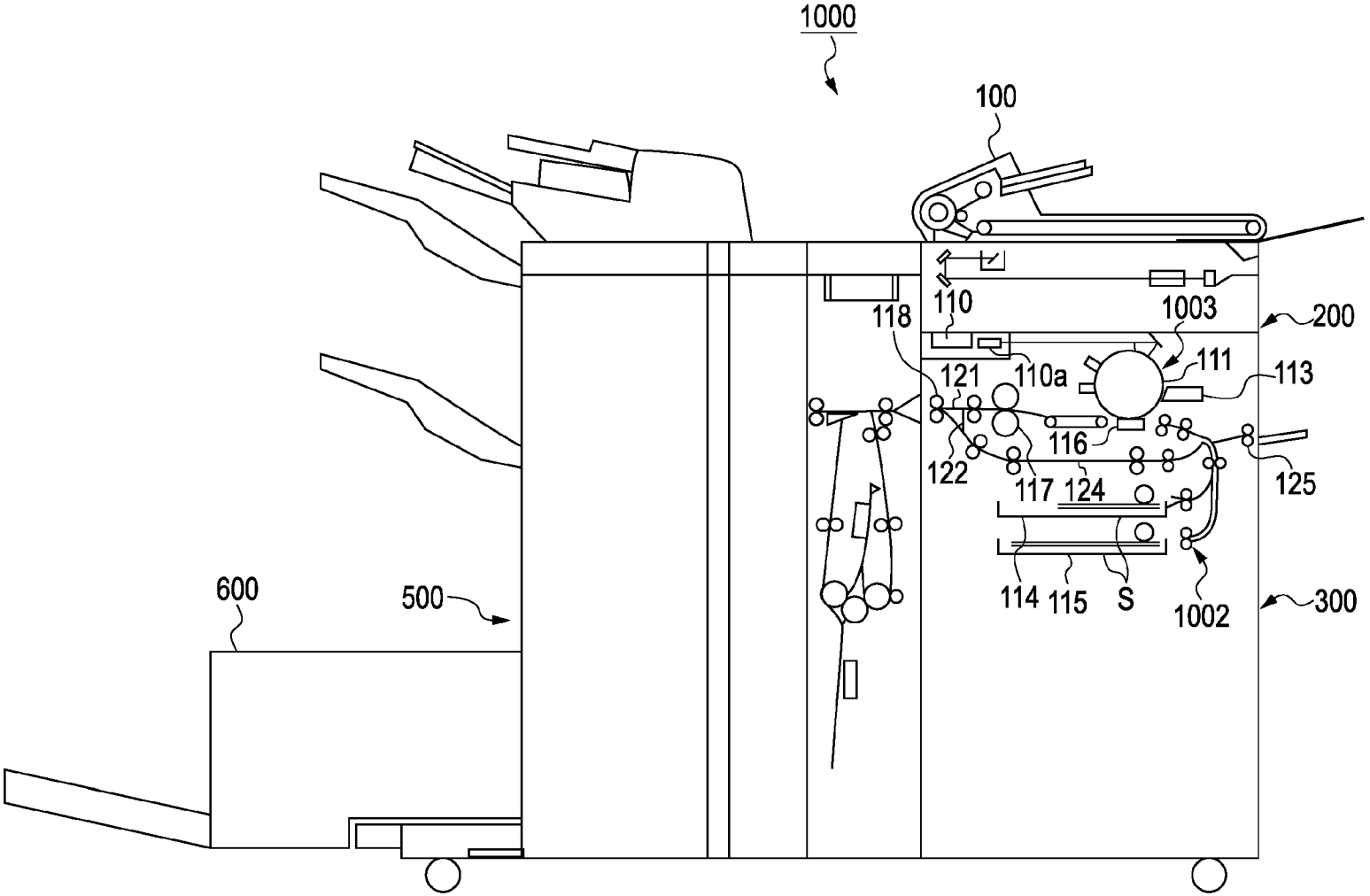
FIG. 1 is a cross-sectional view of a copying apparatus, which is an example of an image forming apparatus according to an embodiment of the present invention.
Figure 2:
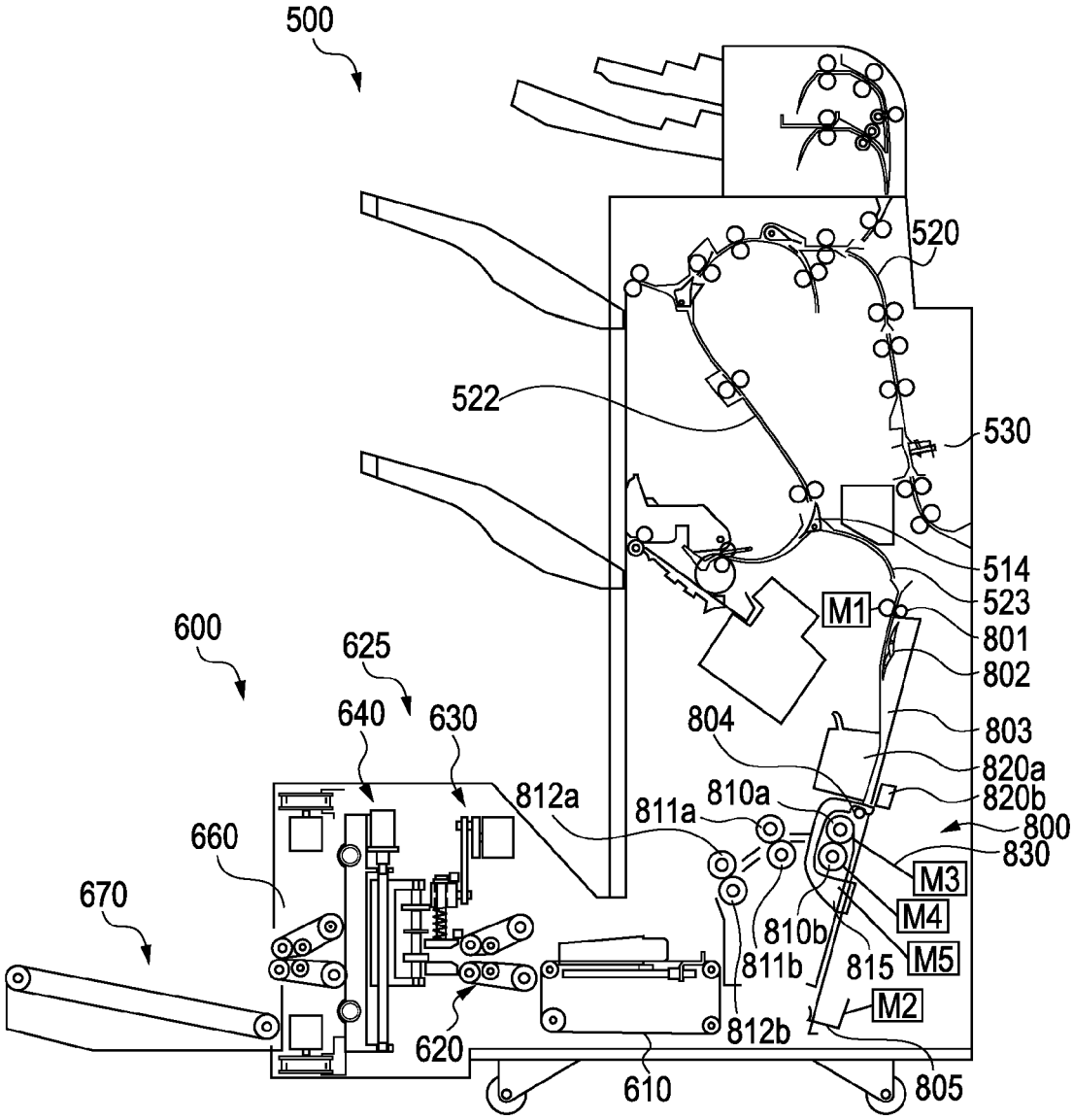
FIG. 2 illustrates the configuration of a sheet processing apparatus connected to the copying apparatus.

FIG. 1 is a cross-sectional view of a copying apparatus 1000 serving as an image forming apparatus to which a sheet processing apparatus according to the present invention is connectable. FIG. 2 illustrates a general configuration of a relevant part of the sheet processing apparatus according to the present invention. The copying apparatus 1000 includes a document feeder portion 100, an image reader portion 200, and a printer portion 300, and may optionally include a finisher 500, a saddle-binding portion 800, and a squaring device 600.

A document is conveyed to a reading position by the document feeder portion 100, and image data of the document read at the reading position by the image reader portion 200 undergoes predetermined image processing before being sent to an exposure control portion 110. The exposure control portion 110 outputs a laser beam in accordance with an image signal. The output laser beam is emitted onto a photosensitive drum 111 while being scanned by a polygonal mirror 110*a*. An electrostatic latent image according to the scanned laser beam is formed on the photosensitive drum 111.

The electrostatic latent image formed on the photosensitive drum 111 is developed and made visible into a toner image by a developing unit 113 that constitutes an image forming portion 1003 together with the photosensitive drum 111 and a transfer portion 116, to be described below. On the other hand, a recording sheet (simply referred to as "sheet" hereinafter) is conveyed to the transfer portion 116 from any one of cassettes 114 and 115, a manual feeder portion 125, and a duplex conveying path 124 that constitute a sheet feeding portion 1002. Then, the visible toner image is transferred onto the sheet at the transfer portion 116. The sheet after the transfer process undergoes a fixing process at a fixing portion 117.

The sheet passing through the fixing portion 117 is temporarily guided to a path 122 by a switch member 121 and is switched back after the trailing edge of the sheet passes the switch member 121 so as to be conveyed to an eject roller 118 by the switch member 121. The eject roller 118 ejects the sheet from the printer portion 300. Thus, the sheet can be ejected from the printer portion 300 in a state where the surface thereof having the toner image is faced down. This will be referred to as "inverted ejection".

As mentioned above, by ejecting the sheet faced down, the page order of sheets to be ejected can be collated when, for example, performing an image forming process using the document feeder portion 100 or performing an image forming process for image data from a computer.

Furthermore, when performing an image forming process on both sides of a sheet, the sheet is guided straight from the fixing portion 117 to the eject roller 118, is switched back immediately after the trailing edge of the sheet passes the switch member 121, and is guided to the duplex conveying path by switching the switch member 121.

Next, the configuration of the finisher 500 will be described with reference to FIGS. 1 and 2.

The finisher 500 is configured to perform sheet processing, which includes receiving sheets conveyed from the printer portion 300 by the eject roller 118 and aligning and binding the sheets into a single sheet bundle, stapling the sheet bundle, sorting the sheets, and non-sorting.

Referring to FIG. 2, the finisher 500 has a conveying path 520 for receiving a sheet conveyed from the printer portion 300 into the apparatus, and conveys the sheet to a lower ejection path 522 for supplying the sheet to the saddle-binding portion 800. The conveying path 520 is provided with a punching unit 530 that punches holes in a trailing-edge section of a conveyed sheet where necessary, and a plurality of conveying-roller pairs.

Next, the configuration of the saddle-binding portion 800 will be described.

A sheet whose conveying direction is switched towards the saddle-binding portion 800 by a switch member 514 provided at an intermediate section of the lower ejection path 522 travels through a saddle ejection path 523 so as to be sent to the saddle-binding portion 800. The conveyed sheet is delivered to a pair of saddle entrance rollers 801. In accordance with the sheet size, the entrance for the sheet is selected by a switch member 802 driven by a solenoid, and the sheet is delivered into an accommodating guide 803 of the saddle-binding portion 800. The delivered sheet is further conveyed by a sliding roller 804 until the leading edge thereof comes into contact with a movable sheet-positioning member 805. The pair of saddle entrance rollers 801 and the sliding roller 804 are driven by a driving motor M1.

A stapler 820 is provided at an intermediate position of the accommodating guide 803. The stapler 820 is divided into two components disposed facing each other with the accommodating guide 803 therebetween. The two components are a driver 820*a* that pierces a sheet with a staple and an anvil 820*b* that bends the pierced staple.

During a sheet conveying process, the aforementioned sheet-positioning member 805 causes a midsection of a sheet in the conveying direction to stop at a position aligned with the binding position of this stapler 820. The sheet-positioning member 805 is movable by being driven by a driving motor M2 and changes its position in accordance with the sheet size.

A pair of folding rollers 810*a* and 810*b* is provided on the downstream side of the stapler 820, and a thrusting member 830 constituting a folding unit together with the pair of folding rollers 810*a* and 810*b* is provided at a position facing the pair of folding rollers 810*a* and 810*b*. This thrusting member 830 has a home position at a position receded from the accommodating guide 803. When driven by a driving motor M3, the thrusting member 830 thrusts an accommodated sheet bundle into a nip between the folding rollers 810*a* and 810*b* so as to fold the sheet bundle.

Subsequently, the thrusting member 830 returns to its home position. A force F1 sufficient for giving the sheet bundle a fold line is applied between the folding rollers 810*a* and 810*b* by a spring (not shown). The sheet bundle given a fold line (folded sheet bundle) is ejected to a conveyor tray 670 via a first pair of folding conveying rollers 811*a* and 811*b* and a second pair of folding conveying rollers 812*a* and 812*b*.

Forces F2 and F3 sufficient for conveying and holding the folded sheet bundle are also applied to the first pair of folding conveying rollers 811 and the second pair of folding conveying rollers 812, respectively. The pair of folding rollers 810, the first pair of folding conveying rollers 811, and the second pair of folding conveying rollers 812 are rotated at a uniform rate by a single driving motor M4.

When a sheet bundle bound by the stapler 820 is to be folded, the sheet-positioning member 805 is lowered after the stapling process by a predetermined distance from the position at the time of the stapling process so that the stapled position of the sheet bundle is aligned with the nip position of the pair of folding rollers 810. Thus, the sheet bundle can be folded along the stapled position thereof.

A pair of alignment plates 815 each have a surface extending externally around the outer surfaces of the pair of folding rollers 810*a* and 810*b* and protruding into the accommodating guide 803, and is configured to align the sheets accommodated in the accommodating guide 803. The alignment plates 815 are moved toward each other for sandwiching the sheets therebetween by being driven by a driving motor M5 so as to position the sheets in the width direction thereof.

With the saddle-binding portion 800 having the above-described configuration, a folded sheet bundle (referred to as "booklet" hereinafter) is formed.

Next, the squaring device 600 that performs a squaring (deformation) process by angularly deforming the spine of a folded section (referred to as "folded spine" hereinafter) of a booklet. The squaring device 600 is positioned downstream (left side in the drawings) of the saddle-binding portion 800.

Figure 3:
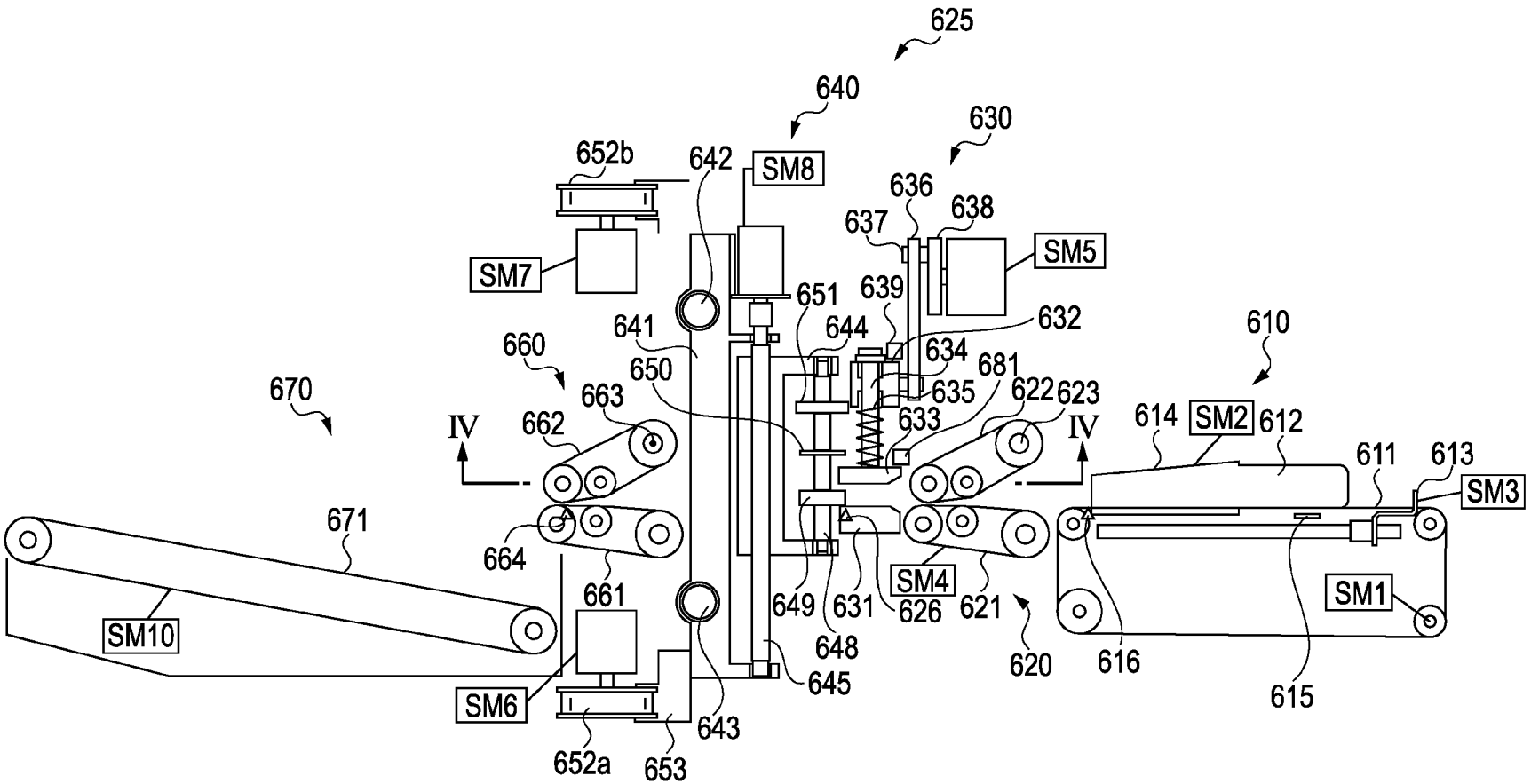
FIG. 3 illustrates the configuration of the sheet processing apparatus.

FIG. 3 is an enlarged view of the squaring device 600 in FIG. 2. Reference numeral 610 denotes a receiving portion that includes a lower conveying belt 611 only at the lower side thereof that supports the booklet. Specifically, the lower conveying belt 611 extends in the conveying direction and is for receiving and conveying a booklet from the saddle-binding portion 800. Should the booklet fall from the second pair of folding conveying rollers 812 when delivering the booklet, the booklet can still be received in the same orientation without being rotated since the lower conveying belt 611 is rotating in the conveying direction.

At the outer side of the lower conveying belt 611, two side guides 612 are disposed on opposite sides thereof. The pair of side guides 612 moves in the width direction of the booklet that is orthogonal to the conveying direction thereof so as to correct the position of the booklet in the width direction. A holding guide 614 that prevents the booklet from opening is provided on the upper side of the pair of side guides 612 and functions as a guide for smoothly delivering the booklet downstream in the conveying direction.

Furthermore, conveying claws 613 that move parallel to the lower conveying belt 611 are disposed on opposite sides of the lower conveying belt 611. The conveying claws 613 move forward and backward together with the lower conveying belt 611 at substantially the same speed in the conveying direction. If a slippage occurs between the lower conveying belt 611 and the booklet, the conveying claws 613 come into contact with the trailing edge of the booklet so as to reliably push the trailing edge of the booklet downstream. The lower conveying belt 611, the pair of side guides 612, and the conveying claws 613 are actuated by being driven by a driving motor SM1, a driving motor SM2, and a driving motor SM3, respectively.

Reference numeral 620 denotes an entrance conveying portion that includes a lower conveying belt 621 and an upper conveying belt 622 for receiving the booklet from the receiving portion 610 and conveying the booklet downstream in the conveying direction. The upper conveying belt 622 is pivotable about a support shaft 623 in accordance with the thickness of the booklet and is pressed towards the lower conveying belt 621 by a spring (not shown). The lower and upper conveying belts 621 and 622 are driven by a driving motor SM4.

Reference numeral 615 denotes an entrance detection sensor configured to detect that the booklet is received from the saddle-binding portion 800 and is on the lower conveying belt 611. Reference numeral 616 denotes an exit detection sensor that detects a booklet and generates an input signal for actuating the pair of side guides 612 and the conveying claws 613.

Reference numeral 625 denotes a deformation processing portion including a holding unit 630 that holds the folded section of the booklet by sandwiching the folded section from above and below and a squaring unit 640 that positions the folded spine of the booklet and comes into pressure contact with the folded spine.

The holding unit 630 serving as a holding unit is made up of an upper unit that moves vertically and a lower holding plate 631 facing the upper unit and fixed to a frame. The upper unit includes a firm holding base 632 that moves vertically via link members 636, 637, and 638 by being driven by a driving motor SM5 and an upper holding plate 633 linked to the holding base 632 with a slidable link member 634, and a compression spring 635 is disposed around the outer periphery of the slidable link member 634.

The lower and upper holding plates 631 and 633 serving as a pair of holding members have opposing holding surfaces that are parallel to each other. When the holding base 632 is at an upper position, the booklet is conveyed into a space between the opposing holding surfaces. When the holding base 632 is at a lower position, the compression spring 635 that expands and contracts in accordance with the thickness of the booklet causes the holding surfaces of the lower holding plate 631 and the upper holding plate 633 to securely nip and hold the booklet. Because the holding surfaces of the lower and upper holding plates 631 and 633 for the booklet are smooth surfaces without any protrusions, the booklet is prevented from receiving pressing marks when the booklet is nipped and held by these surfaces. Reference numeral 639 denotes an upper-dead-center detection sensor that detects that the holding base 632 is at the upper position. Reference numeral 681 denotes a thickness detection sensor that serves as a thickness detecting portion and detects the thickness of the booklet by detecting the position of the upper holding plate 633 when the booklet is in a held state.

Figure 4:
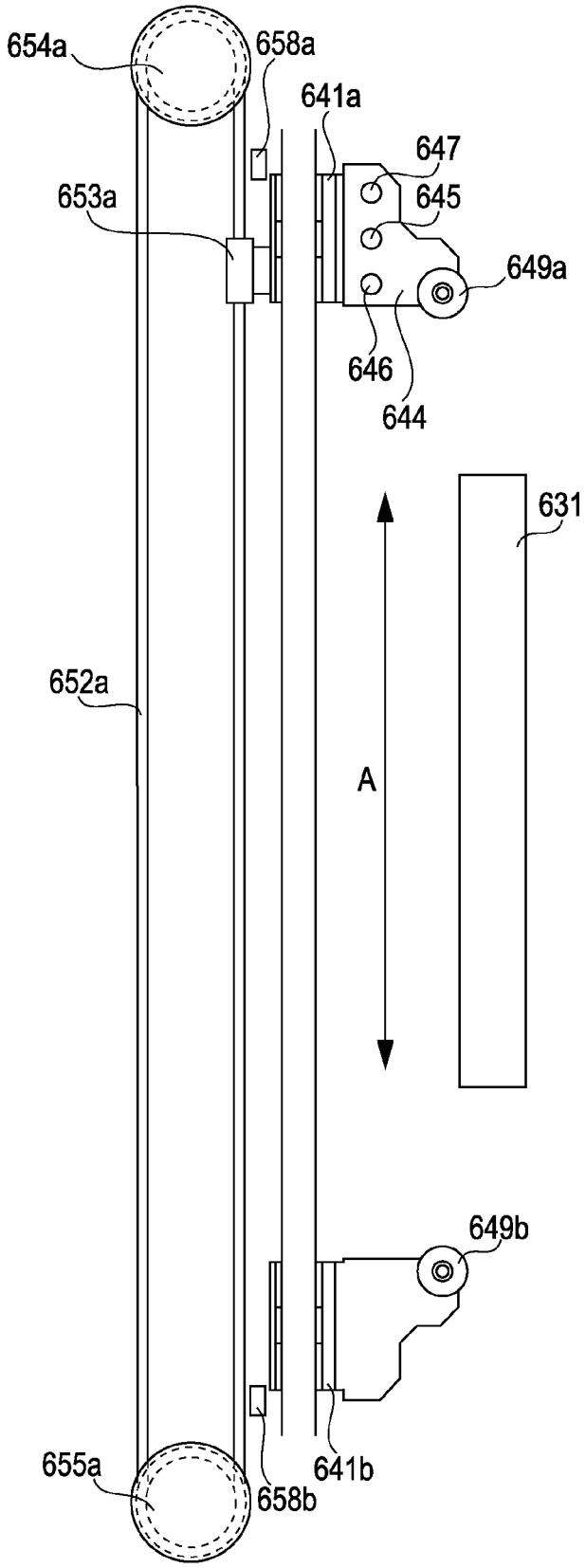
FIG. 4 is a diagram viewed along an arrow IV-IV in FIG. 3.
Figure 5:
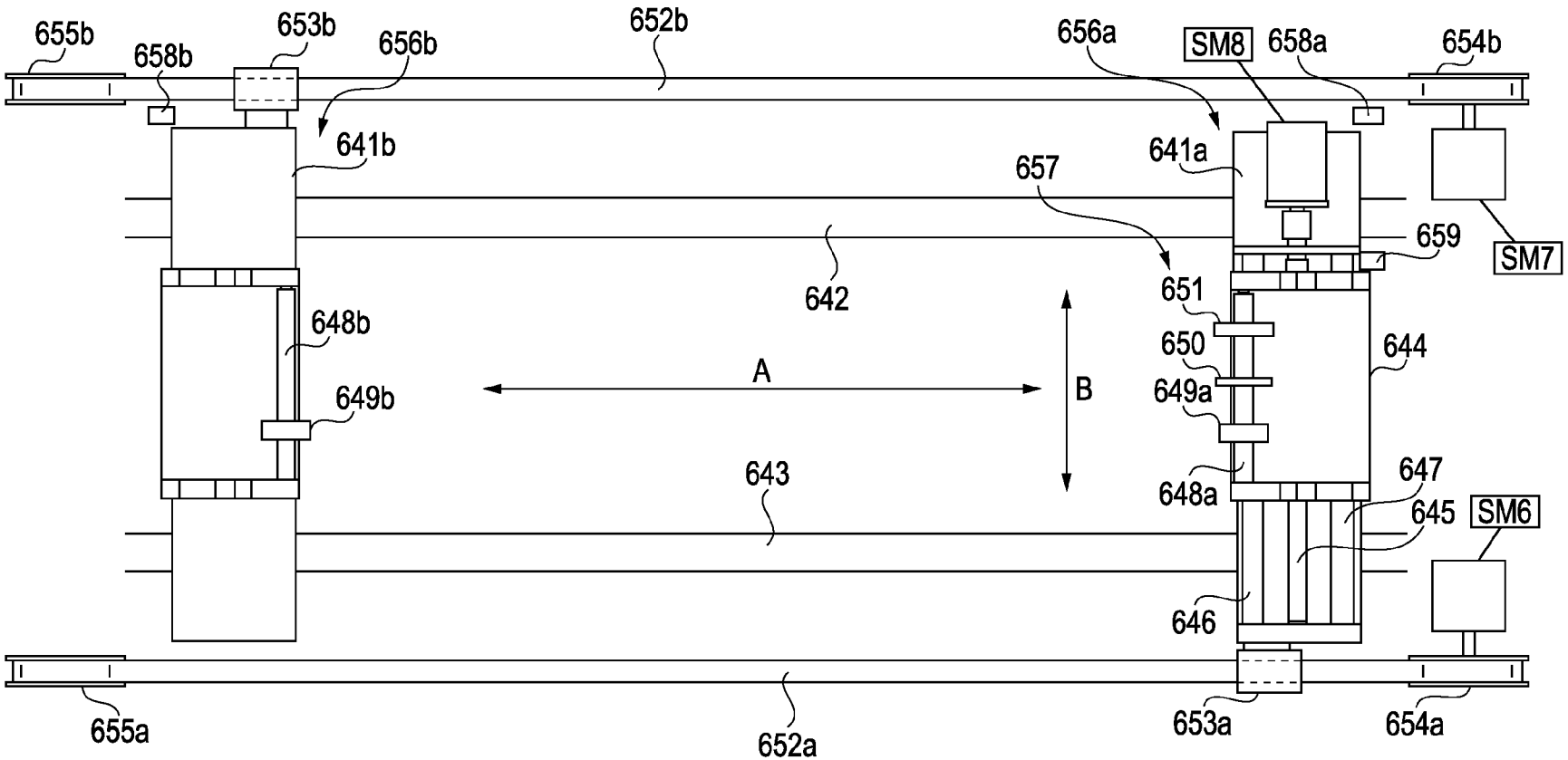
FIG. 5 illustrates the sheet processing apparatus, as viewed from an upstream side in the conveying direction.

Next, the squaring unit 640 will be described with reference to FIGS. 3, 4, and 5. FIG. 4 is a diagram viewed along an arrow IV-IV in FIG. 3. FIG. 5 illustrates the squaring unit 640 in FIG. 3, as viewed from the upstream side in the conveying direction.

The squaring unit 640 includes a movable unit 656*a* supported in a movable manner in the direction indicated by an arrow A in FIGS. 4 and 5 along sliding shafts 642 and 643 supported by a frame body (not shown). The movable unit 656*a* is attached to a timing belt 652*a* via a link member 653*a* and is driven by a driving motor SM6 via pulleys 654*a* and 655*a*.

The movable unit 656*a* has a movable base 641*a*, and a switch unit 657 is slidably supported by sliding shafts 646 and 647 fixed to the movable base 641*a*. The switch unit 657 can be moved by a sliding screw 645 and a driving motor SM8 in the direction of an arrow B in FIG. 5 along the sliding shafts 646 and 647. In the switch unit 657, a support shaft 648*a* is rotatably attached to a switch base 644, and the support shaft 648*a* has fixed thereto a stopper 649*a* serving as a positioning member, a first pressing member 650 serving as a pressing member, and a second pressing member 651 serving as a pressing member.

The stopper 649*a* works in conjunction with a stopper 649*b*, to be described later, to serve as a positioning member that positionally sets the conveyed booklet at the squaring (deformation) position by allowing the folded spine thereof to abut on the stoppers.

The first pressing member 650 and the second pressing member 651 are pressing members that square the curve-shaped folded spine of the booklet by coming into pressing with the folded spine so as to angularly deform the folded spine. The two pressing members 650 and 651 have different pressing widths in the thickness direction of the booklet when coming into pressure contact with the folded spine. A selective switching operation between the first pressing member 650 and the second pressing member 651 is performed by moving the switch unit 657 in the direction of the arrow B in FIG. 5 in accordance with the detection result (i.e., the thickness of the booklet) obtained by the thickness detection sensor 681.

The switch unit 657 serving as a switch member is provided with a reference-position detection sensor 659 serving as a detecting portion. Based on a detection result of the reference-position detection sensor 659, a reference position when the switch unit 657 moves in the direction of the arrow B is determined.

The squaring unit 640 further includes a movable unit 656*b* supported in a movable manner in the direction indicated by the arrow A in FIGS. 4 and 5 along the sliding shafts 642 and 643 supported by the frame body (not shown). The movable unit 656*b* is attached to a timing belt 652*b* via a link member 653*b* and is driven by a driving motor SM7 via pulleys 654*b* and 655*b*.

The movable unit 656*b* has a movable base 641*b*. A support shaft 648*b* is rotatably attached to the movable base 641*b*. A stopper 649*b* serving as a positioning member is fixed to the support shaft 648*b*. The stopper 649*b* works in conjunction with the stopper 649*a* to serve as a positioning member that positionally sets the conveyed booklet at the squaring position by allowing the folded spine thereof to abut on the stoppers. The position of the folded spine of the booklet positioned by the stoppers 649*a* and 649*b* is a position inside between the lower holding plate 631 and the upper holding plate 633, serving as a pair of holding members that constitute a holding unit, by a predetermined distance from ends of the pair of holding members.

The movable unit 656*a* and the movable unit 656*b* respectively have reference-position detection sensors 658*a* and 658*b*. Based on detection results of the reference-position detection sensors 658*a* and 658*b*, reference positions when the movable unit 656*a* and the movable unit 656*b* move in the direction of the arrow A are determined.

Figure 6A:
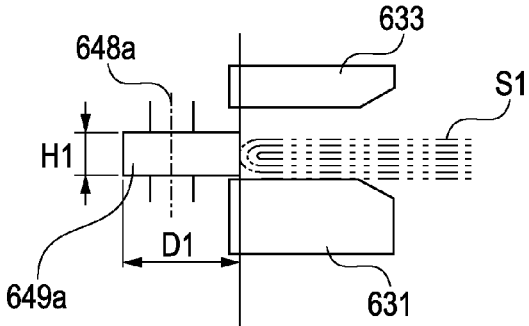
FIGS. 6A to 6F each illustrate the relationship between the thickness of a booklet and a pressing member according to the present invention selected in accordance with the thickness of the booklet.
Figure 6B:
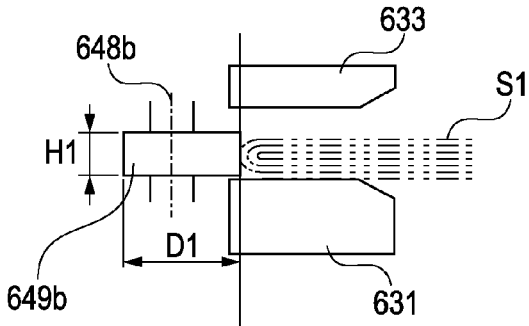

The stoppers 649*a* and 649*b*, the first pressing member 650, and the second pressing member 651 are all disk-shaped and have dimensional relationships as shown in FIGS. 6A to 6F. Referring to FIGS. 6A and 6B, the stoppers 649*a* and 649*b* have a diameter D1 and are configured to enter into the gap between the holding surfaces of the lower and upper holding plates 631 and 633 so as to positionally set the booklet at a position where the folded spine thereof does not protrude from the downstream ends of the lower and upper holding plates 631 and 633 in the conveying direction.

The stoppers 649*a* and 649*b* have a height H1 that is higher than the thickness of a conveyed booklet so that a folded spine of a booklet with a maximum processible thickness can be positioned without passing over the stoppers.

In this embodiment, a booklet that can be made in the saddle-binding portion 800 includes a booklet made by half-folding a single sheet or up to 25 sheets. A booklet made by half-folding one to 10 sheets is not subjected to a squaring process, whereas a booklet made by half-folding 11 to 25 sheets is subjected to a squaring process.

The reason for this is that a booklet made by half-folding one to 10 sheets has a small thickness and it is thus difficult to ensure a deformation area (pressing amount) when the folded spine is to be squared, and that there would be no particular change in the degree of opening of the open side of the booklet even if the booklet were to be squared. In this case, the term "deformation area (pressing amount)" refers to an area extending from the tip of the folded spine prior to the deformation process to a smooth surface of the folded spine to be obtained after the deformation process.

Figure 6C:
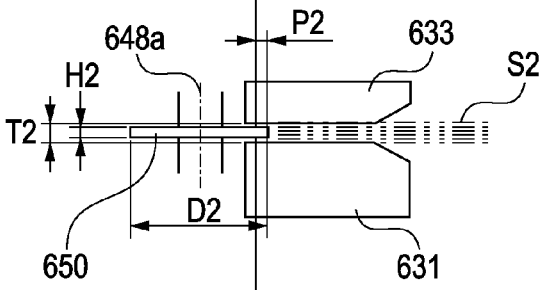
Figure 6D:
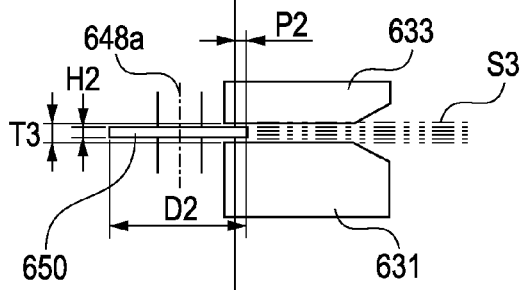

Although a squaring (deformation) process is selectively performed on a booklet made by half-folding 11 to 25 sheets, the squaring process is performed in accordance with the thickness of the booklet being processed. As shown in FIGS. 6C and 6D, when the thickness of the booklet ranges from T2 to T3, the squaring process is performed by using the first pressing member 650 having a height (pressing width) H2.

Figure 6E:
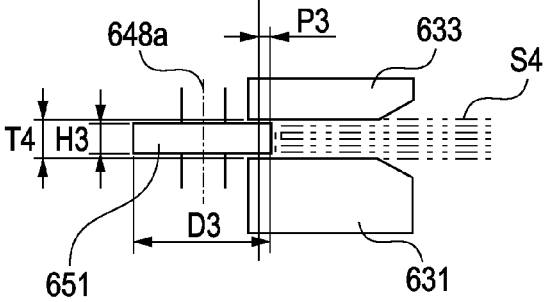
Figure 6F:
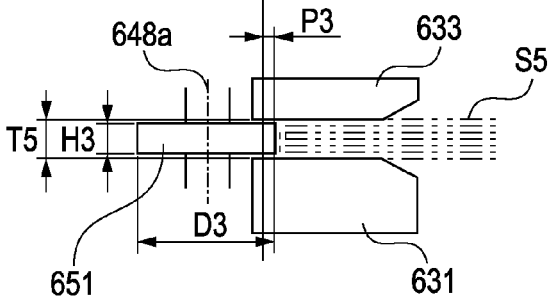

Referring to FIGS. 6E and 6F, the squaring process is performed by switching the pressing members to be used, such that the squaring process is performed by using the second pressing member 651 having a height (pressing width) H3 when the thickness of the booklet ranges from T4 to T5.

The diameter D1 of the stoppers 649*a* and 649*b*, a diameter D2 of the first pressing member 650, and a diameter D3 of the second pressing member 651 have the relationship: D1<D2<D3. When using the first pressing member 650 for performing the squaring process on a relatively thin booklet, the deformation area (pressing amount) is set as P2=(D2−D1)/2. Specifically, the deformation area (pressing amount) by the first pressing member 650 is an area extending from the position of the tip of the folded spine positioned by the stoppers 649*a* and 649*b* to a smooth surface of the folded spine to be obtained after the deformation process by the first pressing member 650.

On the other hand, when using the second pressing member 651 for performing the squaring process on a thick booklet, the deformation area (pressing amount) is set as P3=(D3−

D1)/2, and the deformation area (pressing amount) for the thick booklet is set greater than that for the relatively thin booklet (P2<P3). Specifically, the deformation area (pressing amount) by the second pressing member 651 is an area extending from the position of the tip of the folded spine positioned by the stoppers 649*a* and 649*b* to a smooth surface of the folded spine to be obtained after the deformation process by the second pressing member 651.

Accordingly, a deformation area (pressing amount) when performing a squaring (deformation) process is set on the basis of the diameter of the pressing members but not on the basis of the position of the folded spine positioned by the stoppers. The first pressing member 650 and the second pressing member 651 move inward by a predetermined distance from the ends of the lower holding plate 631 and the upper holding plate 633 so as to come into pressure contact with the folded spine of the booklet. In this embodiment, the holding surfaces of the lower and upper holding plates 631 and 633 in the deformation areas P2 and P3 do not abut on the folded spine of the booklet before the pressing members 650 and 651 come into pressure contact with the folded spine of the booklet. When the pressing members 650 and 651 come into pressure contact with the folded spine of the booklet, the folded spine of the booklet not in abutment with the holding surfaces of the lower and upper holding plates 631 and 633 begins to deform. However, the holding surfaces of the lower and upper holding plates 631 and 633 inhibit deformation that exceeds the gap between the holding surfaces, that is, the thickness of the booklet held by the lower and upper holding plates 631 and 633. In this case, the holding surfaces of the lower and upper holding plates 631 and 633 in the deformation areas P2 and P3 function as regulating portions for regulating deformation of the folded spine in the thickness direction of the booklet. In this manner, deformation of the folded spine in the thickness direction is limited within the gap between the holding surfaces, thereby improving stackability.

Although the regulating portions of the lower and upper holding plates 631 and 633 are set as smooth regulating surfaces that are parallel to each other and extend continuously from the holding surfaces of the lower and upper holding plates 631 and 633 in this embodiment, the regulating portions do not necessarily have to be parallel to each other so long as they are capable of inhibiting deformation that exceeds the thickness of the booklet. Moreover, the regulating surfaces do not necessarily have to extend continuously from the holding surfaces of the lower and upper holding plates 631 and 633, and may be provided as separate components.

By sliding the movable units 656*a* and 656*b*, the stoppers 649*a* and 649*b*, the first pressing member 650, and the second pressing member 651 can move back and forth in the direction of the arrow A in FIG. 4 through between the holding surfaces of the lower and upper holding plates 631 and 633 of the holding unit 630.

When the movable unit 656*a* is positioned outside the holding plates 631 and 633 in the width direction, the pressing member to be inserted between the holding surfaces of the lower and upper holding plates 631 and 633 can be switched by sliding the switch unit 657 in the axial direction. When a booklet delivered from the entrance conveying portion 620 is to be positioned at the holding unit 630, the stoppers 649*a* and 649*b* enter into the gap between the holding surfaces of the lower and upper holding plates 631 and 633 so as to abut on and position the folded spine of the booklet.

Although the folded spine is positioned where it does not protrude from the ends of the lower and upper holding plates 631 and 633 in this embodiment, the positioning of the folded spine is not limited. The advantages of the present invention can still be achieved so long as the deformation process is performed while deformation of the booklet in the thickness direction is regulated by the holding portions of the lower and upper holding plates 631 and 633 so that the folded spine after the deformation process is prevented from protruding from the ends of the lower and upper holding plates 631 and 633. In other words, the folded spine before the deformation process may be positioned where it protrudes from the ends of the lower and upper holding plates 631 and 633.

Figure 7A:
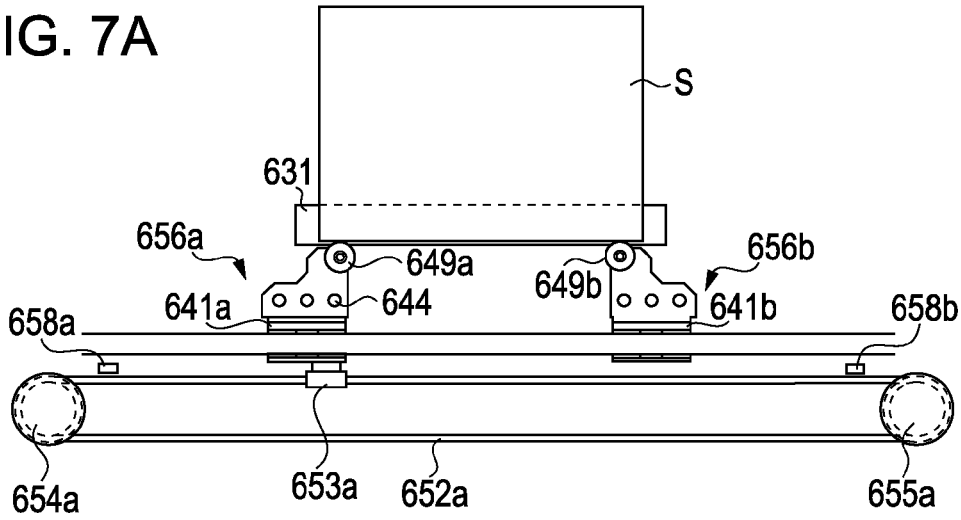
FIGS. 7A to 7C illustrate a squaring process performed in the sheet processing apparatus.

The abutment positions are located within the width of the booklet and are symmetrical to each other with respect to the center of the booklet in the width direction (FIG. 7A). The booklet conveyed to the stoppers 649*a* and 649*b* is detected by a positioning detection sensor 626.

As mentioned above, the stoppers 649*a* and 649*b* are given a height (pressing width) that is higher than the thickness of a booklet so that a folded spine of a booklet with a maximum processible thickness can abut on and be positioned by the stoppers. Therefore, when the stoppers 649*a* and 649*b* are positioned between the lower and upper holding plates 631 and 633, the upper holding plate 633 is incapable of holding the booklet.

Figure 7B:
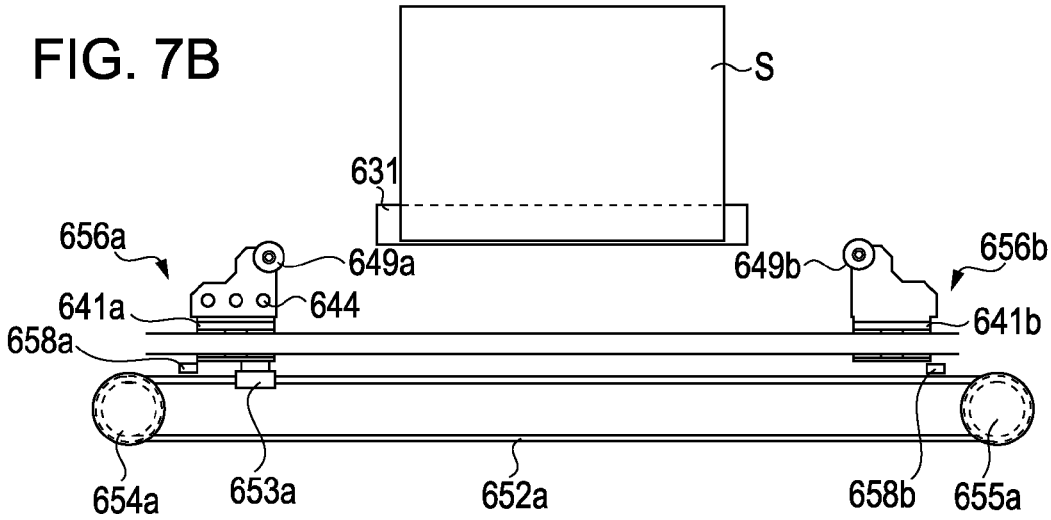

When the vicinity of the folded spine of the booklet is to be nipped and held by the holding unit 630, the stoppers 649*a* and 649*b* are moved outside the lower and upper holding plates 631 and 633 in the width direction after the booklet is set in position, as shown in FIG. 7B. In this case, the folded spine of the booklet does not protrude from the downstream-end surfaces of the lower and upper holding plates 631 and 633, and the booklet is prevented from being shifted since it is nipped by the lower and upper conveying belts 621 and 622 of the entrance conveying portion 620.

Figure 7C:
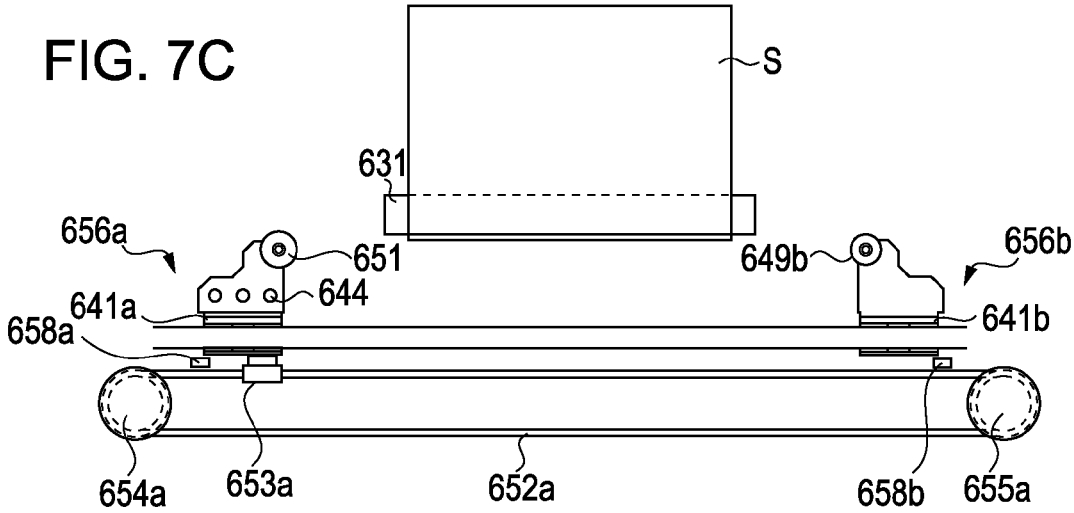
Figure 8A:
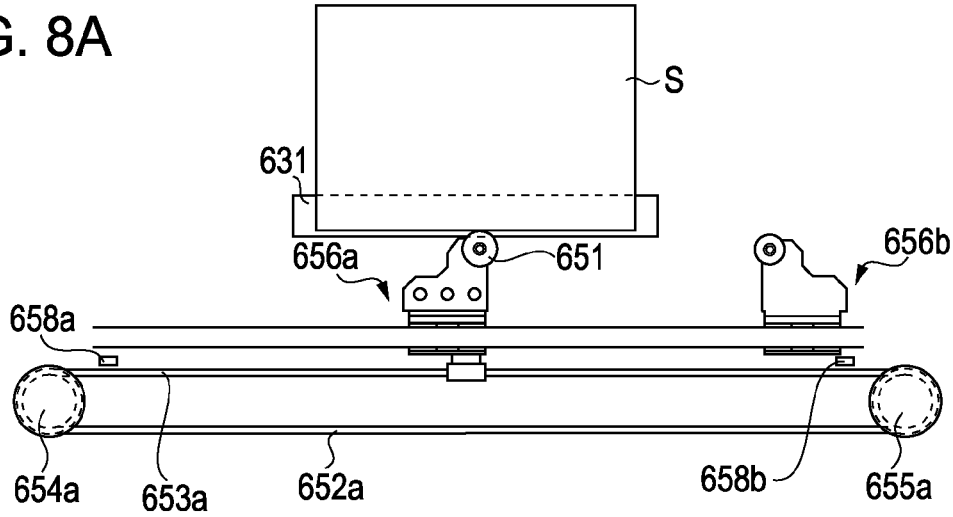
FIGS. 8A to 8C illustrate the squaring process performed in the sheet processing apparatus.
Figure 8B:
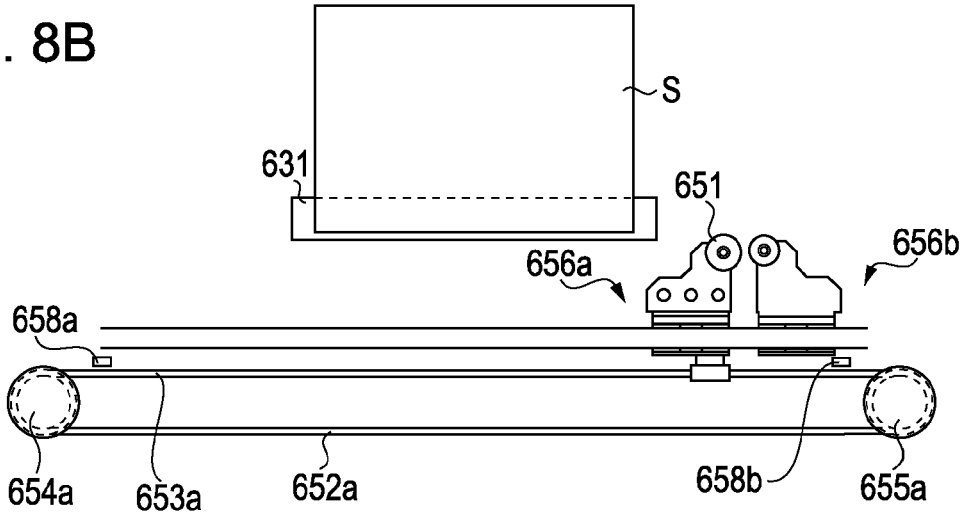

Subsequently, as shown in FIG. 7C, the stopper 649*a* is switched to the first pressing member 650 or the second pressing member 651 by the switch unit 657 in accordance with the thickness of the booklet detected by the thickness detection sensor 681. FIG. 7C illustrates a state where the stopper 649*a* is switched to the second pressing member 651. Then, referring to FIGS. 8A and 8B, a squaring (deformation) process is performed by moving the movable unit 656*a* towards the opposite end of the booklet so as to bring the second pressing member 651 into pressure contact with the folded spine of the booklet.

Figure 8C:
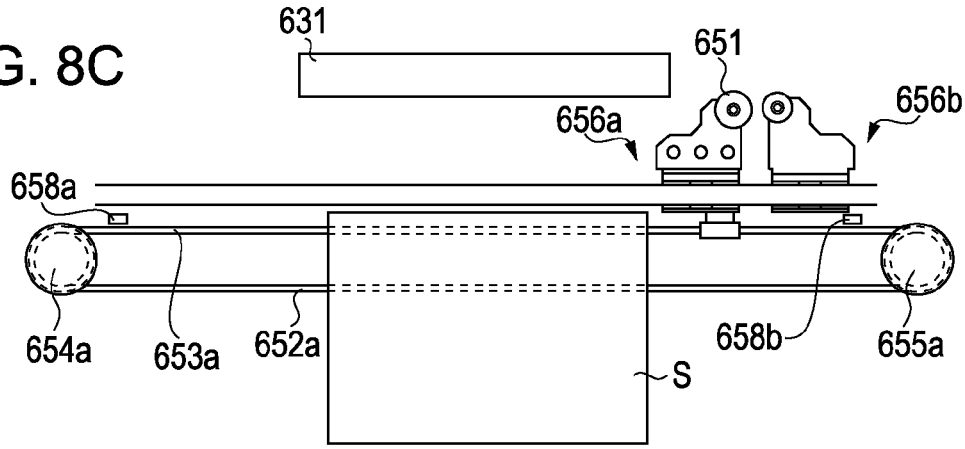
Figure 9:
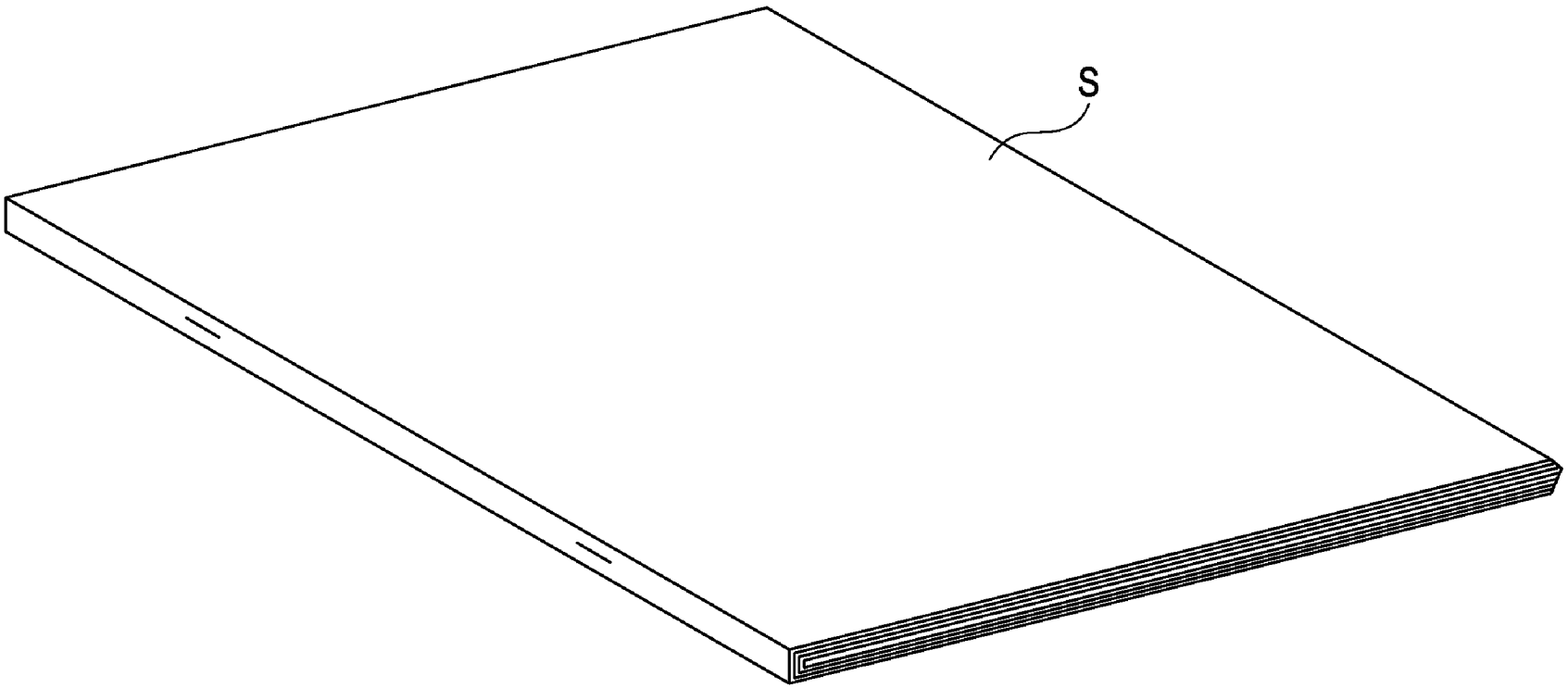
FIG. 9 illustrates a booklet having undergone the squaring process performed by the sheet processing apparatus.

Subsequently, the booklet having undergone the squaring process is conveyed downstream in the conveying direction, as shown in FIG. 8C. FIG. 9 illustrates the booklet with the squared folded spine.

Since the folded spine is pressed and deformed in a state where the folded section of the booklet is held by the lower and upper holding plates 631 and 633 without protruding therefrom, the pressed folded section of the booklet is prevented from widening outward in the thickness direction and the width of the squared spine is prevented from becoming larger than the thickness of the booklet. In addition, since the booklet is prevented from being crushed as a result of receiving an excessive pressing force, the sheets in the central section of the booklet, which do not need to be squared, are prevented from being deformed.

Furthermore, since the folded section of the booklet does not protrude from the downstream ends of the lower and upper holding plates 631 and 633, the deformed folded section of the booklet is prevented from coming into contact with the angular edges of the lower and upper holding plates 631 and 633 when the folded section is pressed by the pressing member, thereby preventing the booklet from receiving pressing marks. Moreover, since the holding surfaces of the lower and upper holding plates 631 and 633 that hold the booklet are smooth surfaces without any protrusions, the booklet is prevented from receiving pressing marks when the booklet is nipped and held by these surfaces. In addition, since a uniform pressing force can be sequentially applied to the folded spine of the booklet by using the rotatable pressing member for pressing the folded section, a booklet with a smooth finish can be made.

Reference numeral 660 in FIG. 3 denotes an exit conveying portion that includes a lower conveying belt 661 and an upper conveying belt 662 for receiving the squared booklet released from the holding unit 630 and conveying the booklet downstream in the conveying direction. The upper conveying belt 662 is pivotable about a support shaft 663 in accordance with the thickness of the booklet and is pressed towards the lower conveying belt 661 by a spring (not shown). The lower and upper conveying belts 661 and 662 are linked to the entrance conveying portion 620 and are driven by the driving motor SM4.

Reference numeral 670 denotes a conveyor tray onto which the booklet ejected from the exit conveying portion 660 is stacked. The lower surface of the conveyor tray 670 is provided with a conveyor belt 671 that moves in the conveying direction by being driven by a driving motor SM10 and that moves repeatedly by a predetermined amount every time a booklet is ejected so as to allow the booklet to be stacked thereon. An ejection detection sensor 664 is provided for detecting that a booklet is ejected from the exit conveying portion 660.

Figure 10:
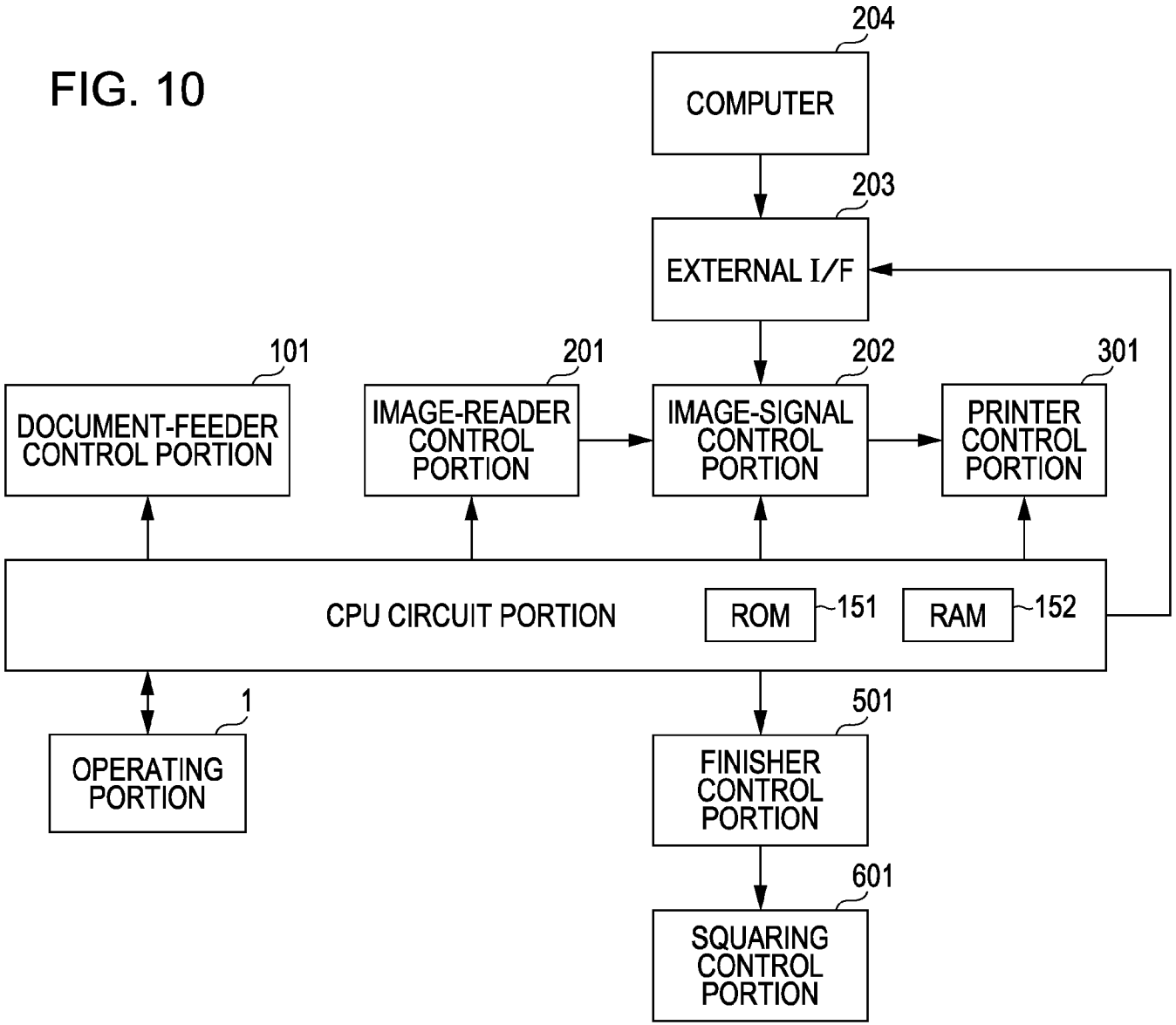
FIG. 10 is a control block diagram of the copying apparatus.

FIG. 10 is a block diagram of the copying apparatus 1000. A CPU circuit portion 150 includes a CPU (not shown) and a ROM 151. A document-feeder control portion 101, an image-reader control portion 201, an image-signal control portion 202, a printer control portion 301, a finisher control portion 501, and an external I/F 203 are controlled on the basis of a control program stored in the ROM 151 and settings in an operating portion 1. The document-feeder control portion 101 controls the document feeder portion 100, the image-reader control portion 201 controls the image reader portion 200, and the printer control portion 301 controls the printer portion 300. The finisher control portion 501 controls the finisher 500 and the saddle-binding portion 800. Furthermore, a squaring control portion 601 controls the squaring device 600 on the basis of a command from the finisher control portion 501.

The operating portion 1 includes a plurality of keys for setting various functions related to image formation and a display portion for displaying the set modes. The operating portion 1 outputs a key signal corresponding to a key operation performed by a user to the CPU circuit portion 150 and displays corresponding information based on the signal from the CPU circuit portion 150 on the display portion.

A RAM 152 is used as an area for temporarily holding control data as well as a work area for calculations related to control. The external I/F 203 serves as an interface between the copying apparatus 1000 and an external computer 204 and develops print data from the computer 204 into a bit-mapped image, and outputs the image to the image-signal control portion 202 as image data. A document image read by the image reader portion 200 is output from the image-reader control portion 201 to the image-signal control portion 202. The printer control portion 301 outputs the image data from the image-signal control portion 202 to the exposure control portion 110.

Figure 11:
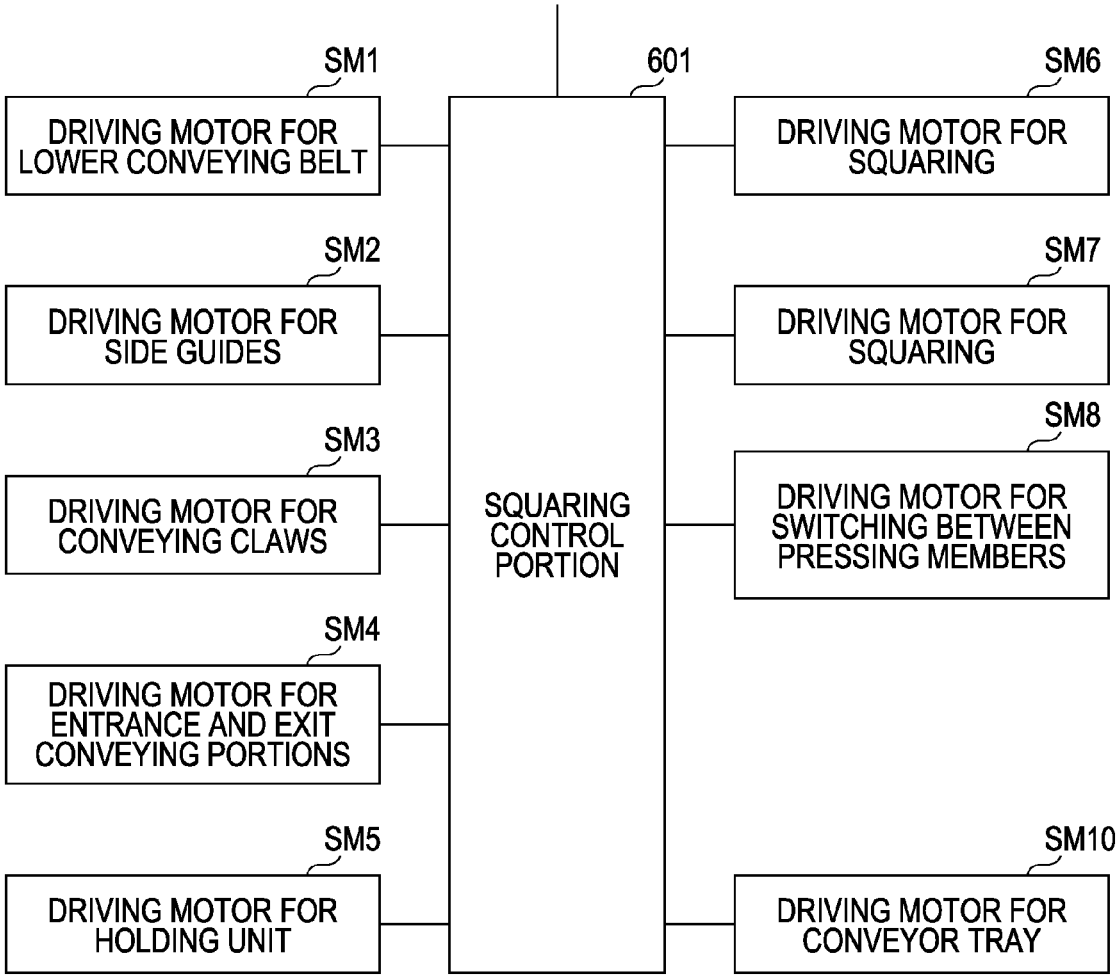
FIG. 11 is a control block diagram of the sheet processing apparatus.

FIG. 11 is a block diagram of the squaring control portion 601. The squaring control portion 601 is configured to control the driving motors.

Based on the above-described configuration, the operation of each component during the squaring (deformation) process performed in the squaring device 600 according to the present invention will now be described together with the movement of the booklet.

First, when a saddle-binding mode is selected in the operating portion 1, selection of whether or not to set a squaring mode can be performed.

If the squaring mode is not selected, a saddle-bound booklet made at the saddle-binding portion 800 is ejected onto the conveyor tray 670 via the lower conveying belt 611, the conveying claws 613, the entrance conveying portion 620, and the exit conveying portion 660. In this case, the pair of side guides 612, the upper holding plate 633, the movable units 656*a* and 656*b* are moved to where they do not block the conveying path.

The operation to be performed when the squaring mode is selected will be described in detail below. FIGS. 12, 13, 14A, and 14B are flow charts showing the flow of operation performed when a squaring mode is selected.

Figure 12:
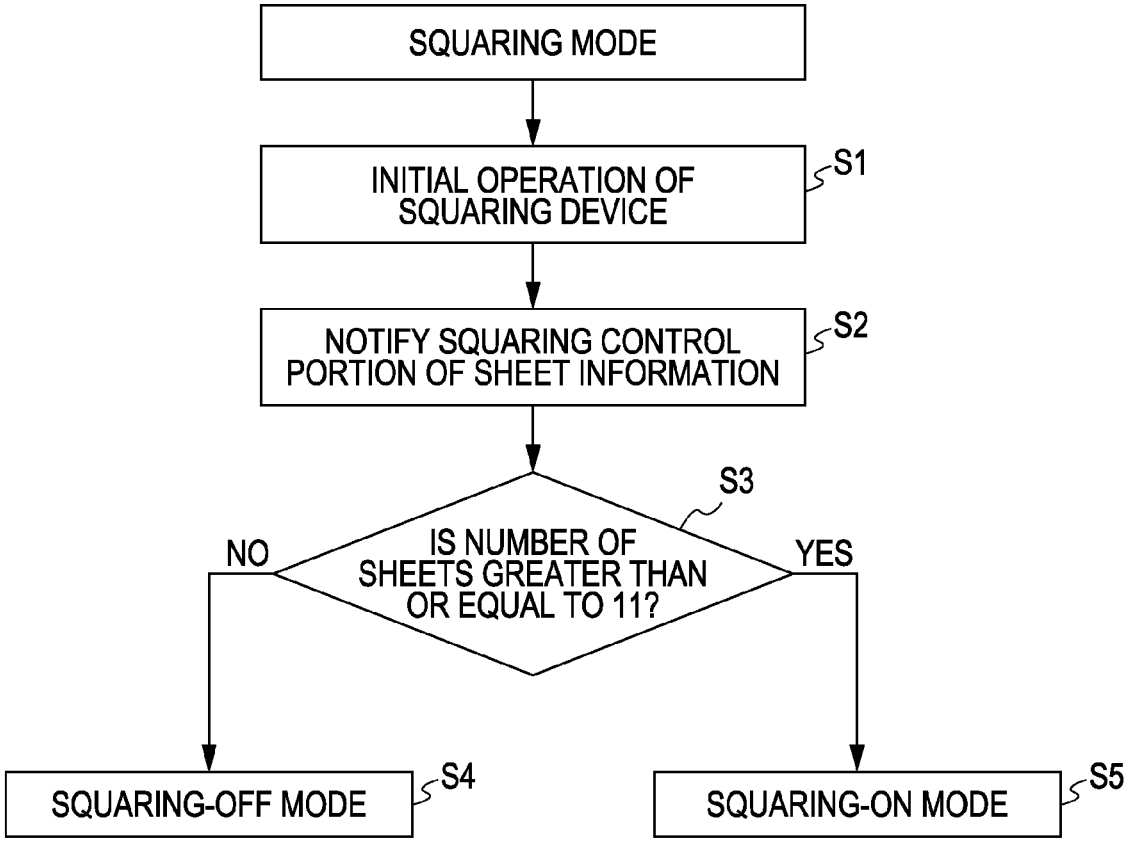
FIG. 12 is a flow chart for explaining the squaring process performed by the sheet processing apparatus.

Referring to FIG. 12, when the squaring mode is selected, the squaring device 600 performs an initial operation in step S1. In detail, the pair of side guides 612 and the conveying claws 613 are set at initial positions, and the holding base 632 is moved to the upper position defined by the upper-dead-center detection sensor 639. The movable units 656*a* and 656*b* move to the respective reference positions defined by the reference-position detection sensors 658*a* and 658*b*, and the switch unit 657 moves to the reference position defined by the reference-position detection sensor 659. When a booklet is to be made at the saddle-binding portion 800, the squaring control portion 601 is notified of sheet information, including the number of sheets in the booklet, the sheet size, and the number of booklets to be made, in step S2 before the booklet is ejected to the receiving portion 610 by the second pair of folding conveying rollers 812. Subsequently, the squaring control portion 601 determines in step S3 whether or not the notified number of sheets in the booklet is greater than or equal to 11 sheets. If the notified number of sheets is not greater than or equal to 11 sheets, the operation proceeds to step S4 where a squaring-OFF mode is selected, whereas if the notified number of sheets is greater than or equal to 11 sheets, the operation proceeds to step S5 where a squaring-ON mode is selected.

Figure 13:
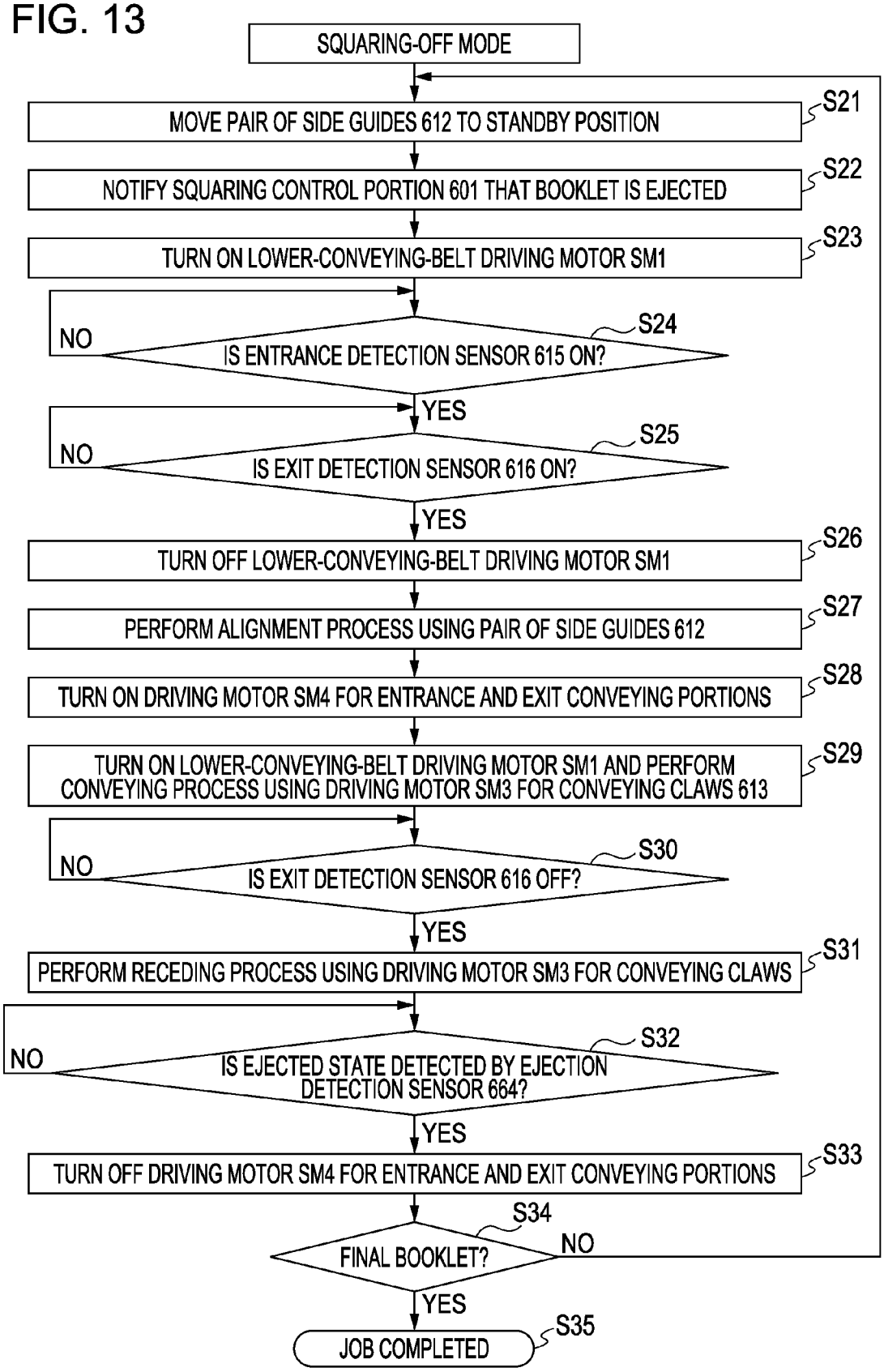
FIG. 13 is a flow chart for explaining the squaring process performed by the sheet processing apparatus.

If the number of sheets in the booklet is smaller than or equal to 10 sheets and the squaring-OFF mode is selected, the operation proceeds to the flow chart shown in FIG. 13.

In step S21, the pair of side guides 612 disposed on opposite sides of the conveying path of the receiving portion 610 moves to a standby position in accordance with the booklet size. When booklet ejection notification is received from the saddle-binding portion 800 in step S22, the lower conveying belt 611 is rotated by the driving motor SM1 in step S23 so as to convey the booklet. After the entrance detection sensor 615 and the exit detection sensor 616 detect a sheet bundle in steps S24 and S25, the conveying process is temporarily stopped in step S26. Subsequently, the pair of side guides 612 performs an alignment process by being driven by a driving motor SM12 in step S27.

Then, the driving motor SM4 drives the entrance conveying portion 620 and the exit conveying portion 660 in step S28, and the conveying claws 613 and the lower conveying belt 611 disposed at the upstream side of the receiving portion 610 resume the conveying process for the booklet in step S29. The conveying claws 613 are driven by the driving motor SM3. Subsequently, the exit detection sensor 616 detects ejection of the booklet in step S30, and the conveying claws 613 recede upstream in step S31.

The booklet conveyed by the entrance conveying portion 620 and the exit conveying portion 660 is ejected onto the conveyor tray 670 and is detected to be in an ejected state by the ejection detection sensor 664 in step S32. In step S33, the driving of the entrance conveying portion 620 and the exit conveying portion 660 is stopped. Booklets ejected onto the conveyor tray 670 are sequentially stacked one on top of the other. In step S34, if an ejected booklet is not the last booklet, the operation returns to step S21, whereas if an ejected booklet is the last booklet, the job ends in step S35.

Figures 14, 14A:
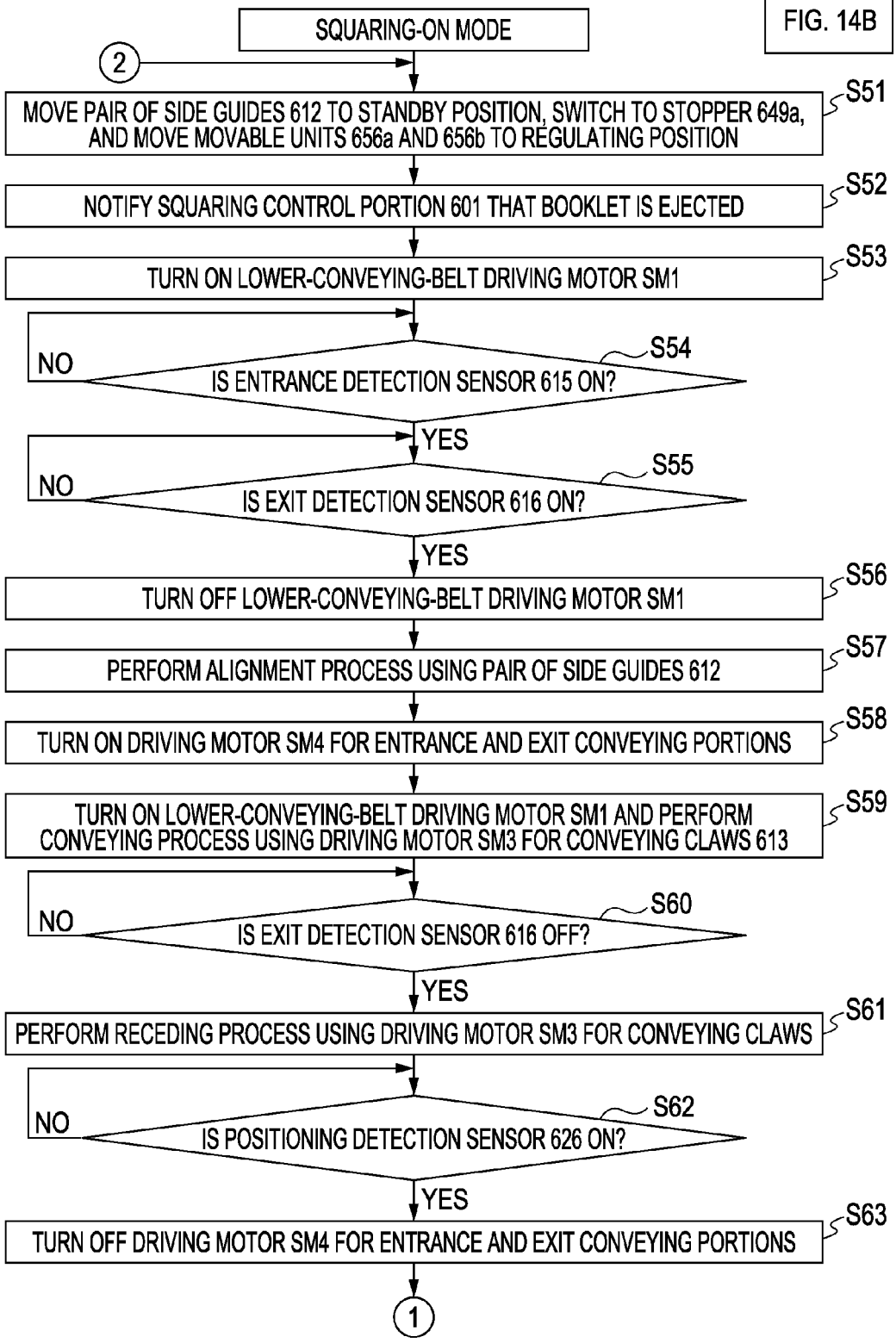
FIGS. 14A and 14B illustrate a flow chart for explaining the squaring process performed by the sheet processing apparatus.
Figure 14B:
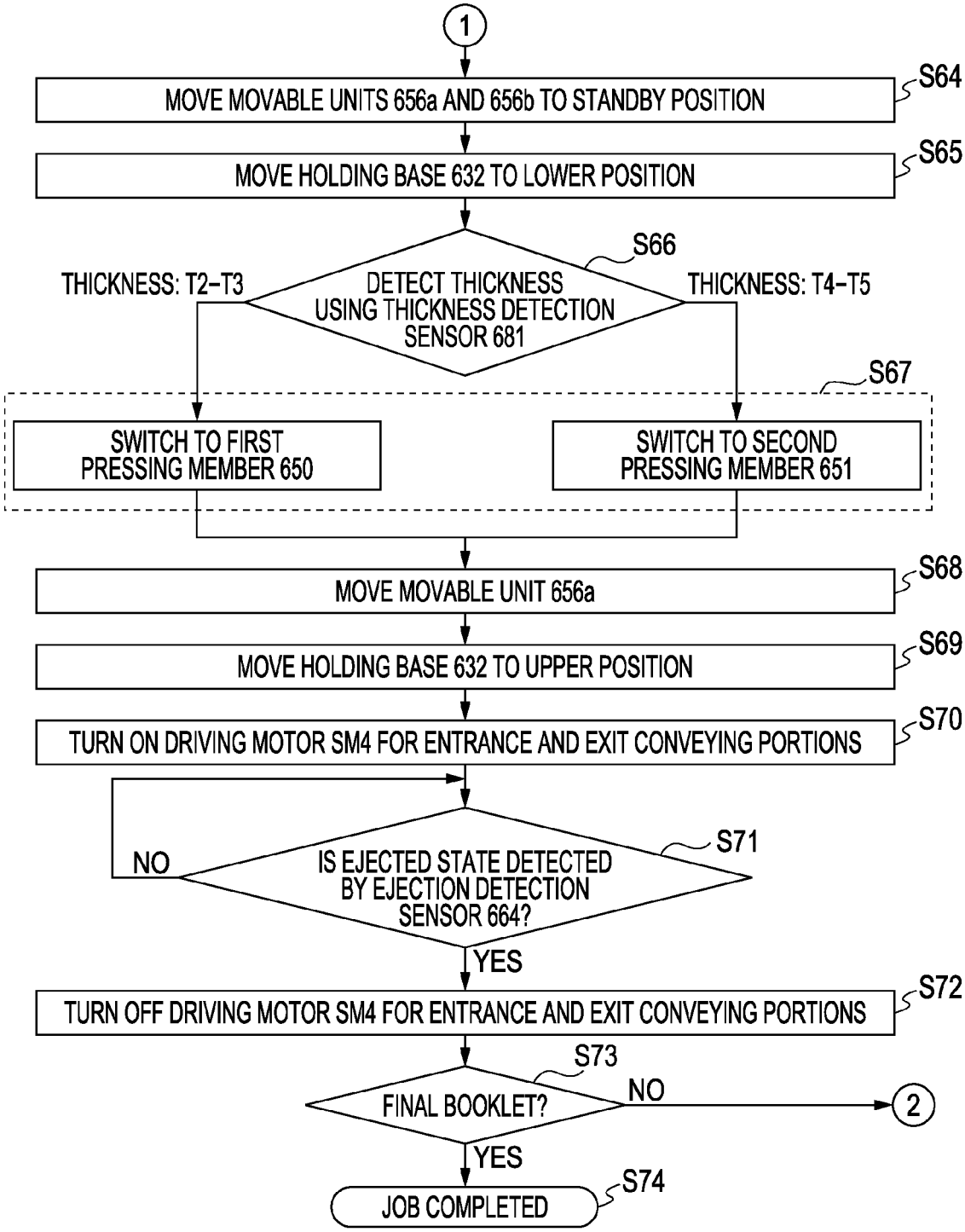

On the other hand, if the number of sheets in the booklet is greater than or equal to 11 sheets and the squaring-ON mode is selected, the operation proceeds to the flow chart shown in FIGS. 14A and 14B.

First, in step S51, the pair of side guides 612 disposed on opposite sides of the conveying path of the receiving portion 610 moves to the standby position in accordance with the booklet size, and the movable units 656*a* and 656*b* switched to the stopper 649*a* by the switch unit 657 move to a regulating position. A regulating position varies depending on the size of the booklet and is a position where the stoppers 649*a* and 649*b* do not rotate when the folded spine of the booklet abuts thereon so that parallelism of the folded spine of the booklet with respect to the moving direction of the movable units 656*a* and 656*b* is maintained.

When booklet ejection notification is received from the saddle-binding portion 800 in step S52, the lower conveying belt 611 is rotated by the driving motor SM1 in step S53 so as to convey the booklet. After the entrance detection sensor 615 and the exit detection sensor 616 detect a sheet bundle in steps S54 and S55, the conveying process is temporarily stopped in step S56. Subsequently, the pair of side guides 612 performs an alignment process by being driven by the driving motor SM12 in step S57.

Then, the driving motor SM4 drives the entrance conveying portion 620 and the exit conveying portion 660 in step S58, and the conveying claws 613 and the lower conveying belt 611 disposed at the upstream side of the receiving portion 610 resume the conveying process for the booklet in step S59. The conveying claws 613 are driven by the driving motor SM3, and when the exit detection sensor 616 detects ejection of the booklet in step S60, the conveying claws 613 recede upstream in step S61.

Figure 15A:
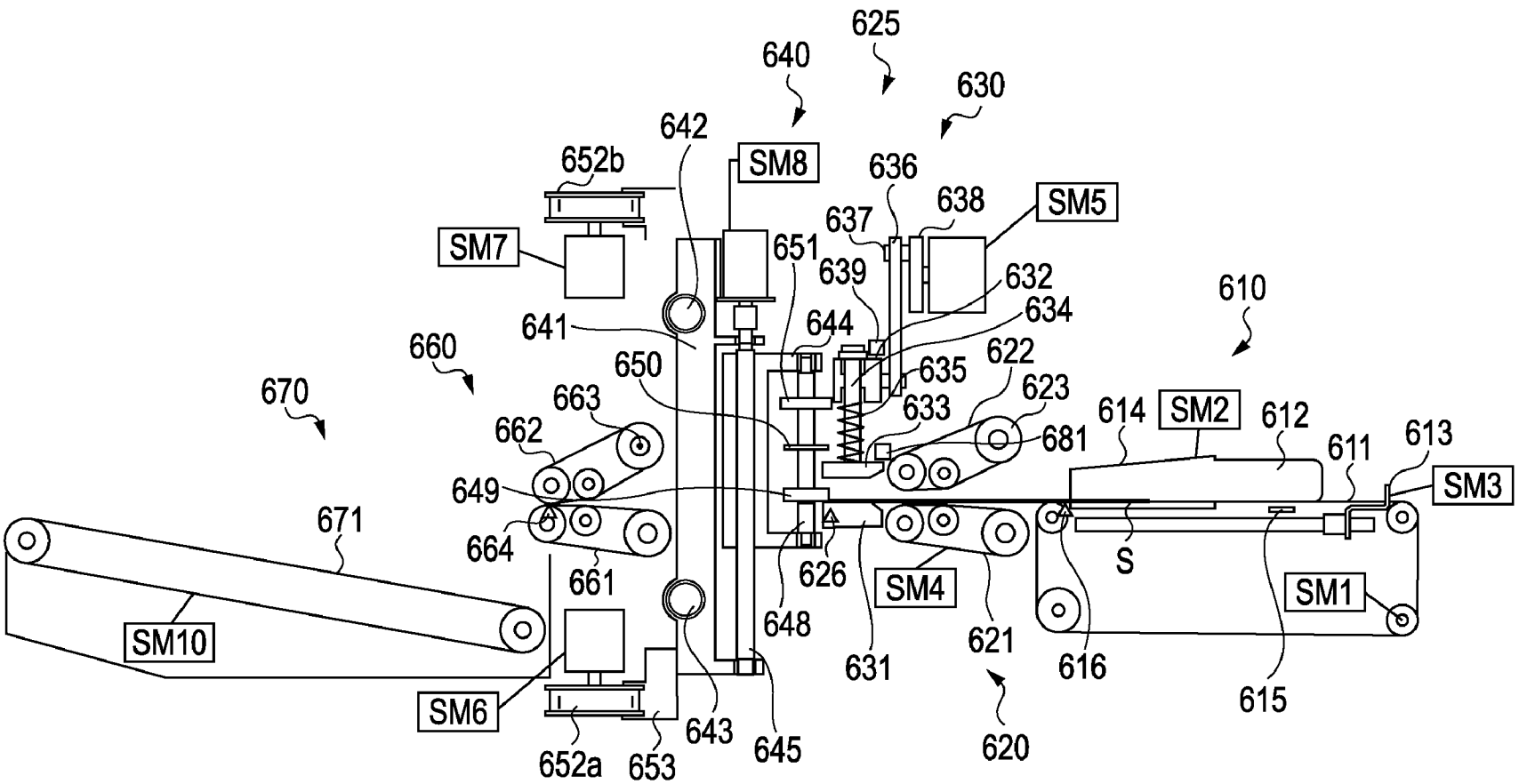
FIGS. 15A to 15C illustrate the squaring process performed by the sheet processing apparatus.

When the booklet conveyed by the entrance conveying portion 620 is detected by the positioning detection sensor 626 in step S62, the driving of the entrance conveying portion 620 is stopped in step S63. In this case, the folded spine of the booklet abuts on the stoppers 649*a* and 649*b*, as shown in FIG. 15A, so as to be positioned where the folded spine does not protrude from the downstream ends of the lower and upper holding plates 631 and 633 in the conveying direction.

Subsequently, in step S64, the movable units 656*a* and 656*b* move from between the lower and upper holding plates 631 and 633 to respective standby positions outside the lower and upper holding plates 631 and 633 in the width direction. In step S65, the holding base 632 is moved to the lower position by the driving motor SM5, causing the booklet to be nipped and held by the lower and upper holding plates 631 and 633.

Subsequently, the position of the upper holding plate 633 nipping and holding the booklet is detected by the thickness detection sensor 681 in step S66, whereby the thickness of the booklet is measured. In step S67, if the detection result obtained by the thickness detection sensor 681 ranges from T2 to T3, the first pressing member 650 is selected, whereas if the detection result ranges from T4 to T5, the second pressing member 651 is selected. Then, the movable unit 656*a* is moved in step S68 so as to square the folded spine of the booklet.

Figure 15B:
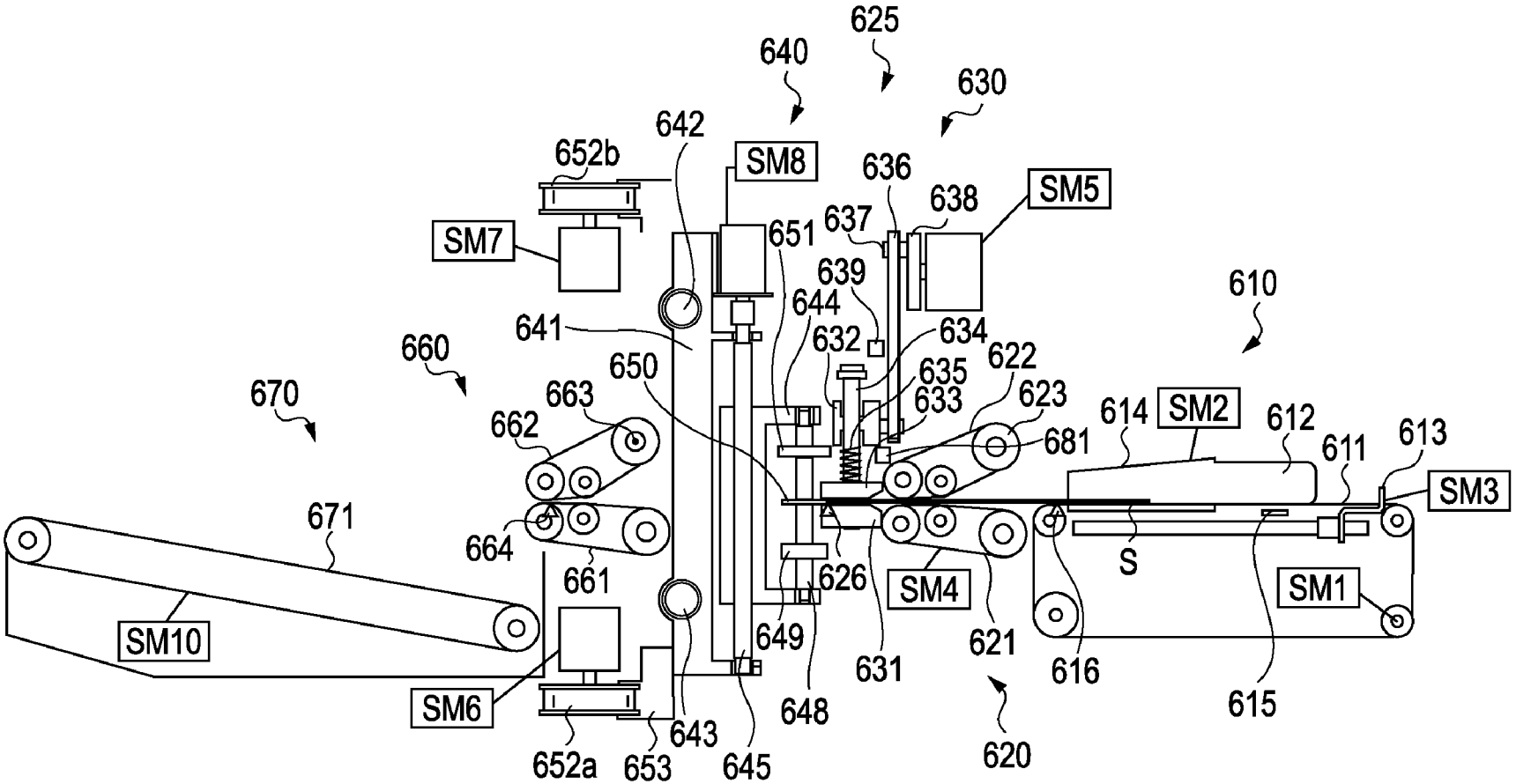
Figure 16A:
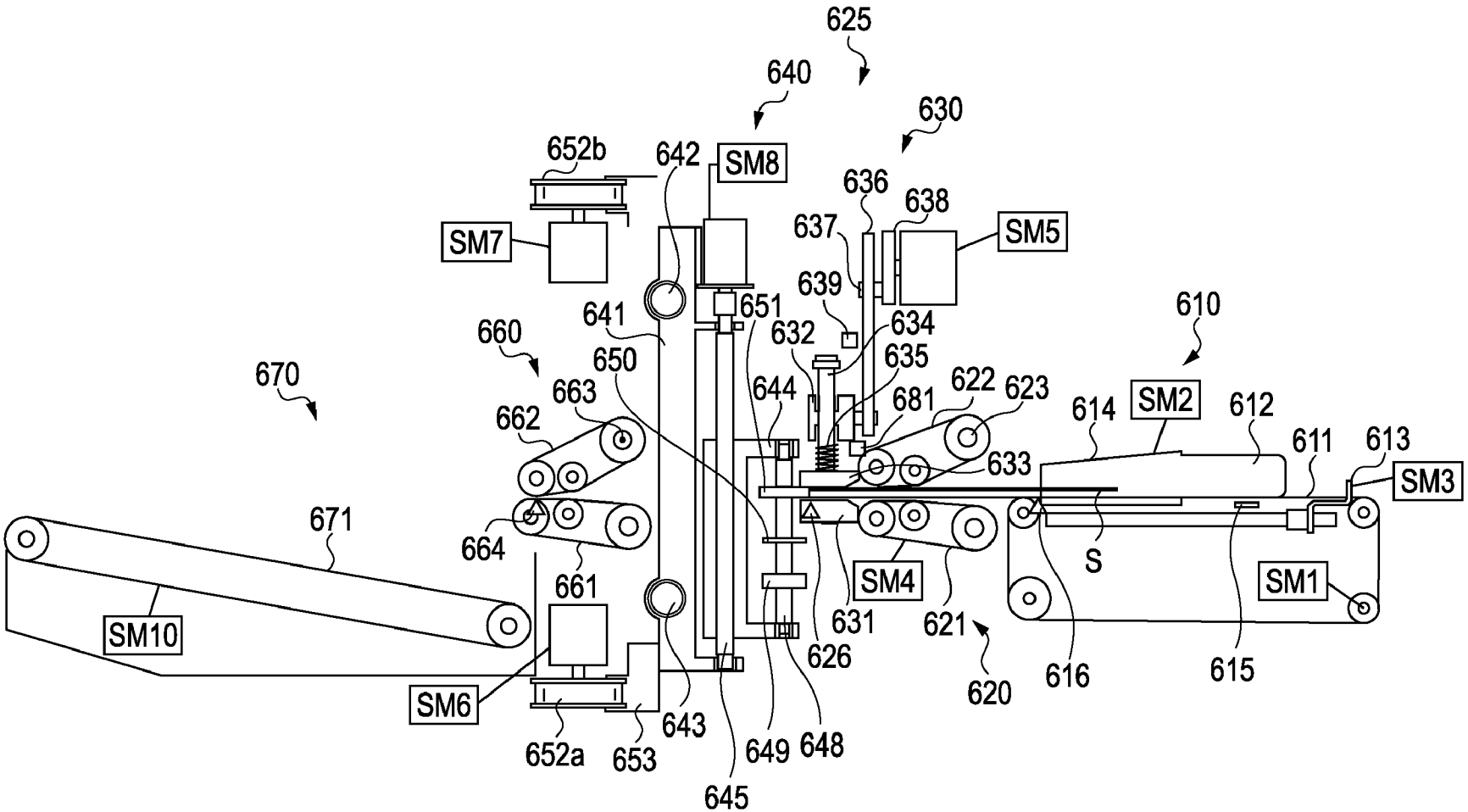
FIGS. 16A and 16B illustrate the squaring process performed by the sheet processing apparatus.

FIG. 15B shows a state where the squaring process is performed by using the first pressing member 650, and FIG. 16A shows a state where the squaring process is performed by using the second pressing member 651.

Since the folded spine of the booklet is held within the lower and upper holding plates 631 and 633 in this manner, pressing marks are prevented from being formed on the front and back covers of the booklet by the holding plates 631 and 633 when the folded spine is being squared.

Furthermore, since the folded spine is surrounded by the lower and upper holding plates 631 and 633 and the pressing member 650 or 651, the folded spine is prevented from receiving an excessive pressing force, and a smooth surface (back) with a width substantially equal to the thickness of the booklet is formed on the folded spine. Consequently, the sheets in the central section of the booklet are prevented from being deformed so that a booklet with a good appearance can be made.

Figure 15C:
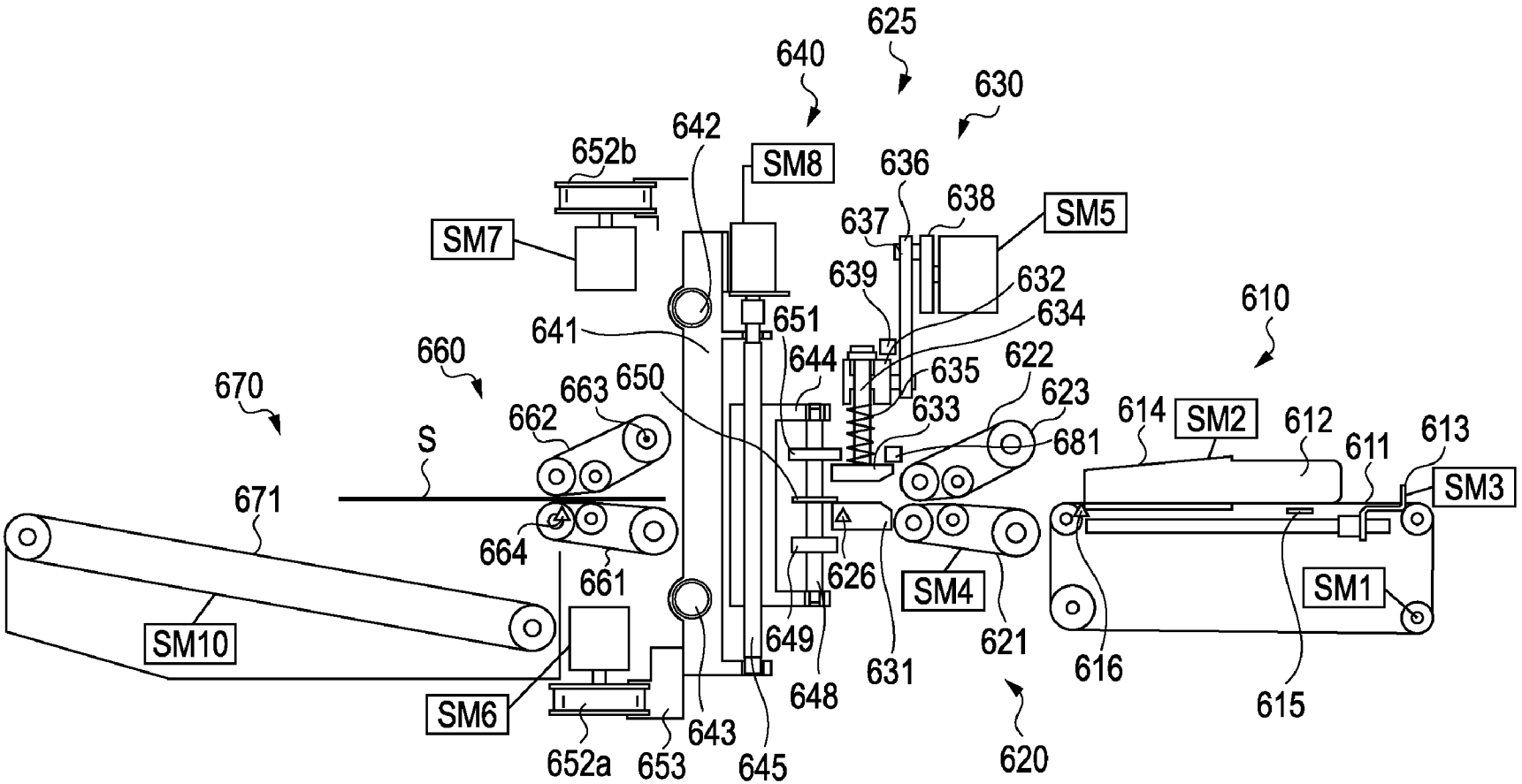
Figure 16B:
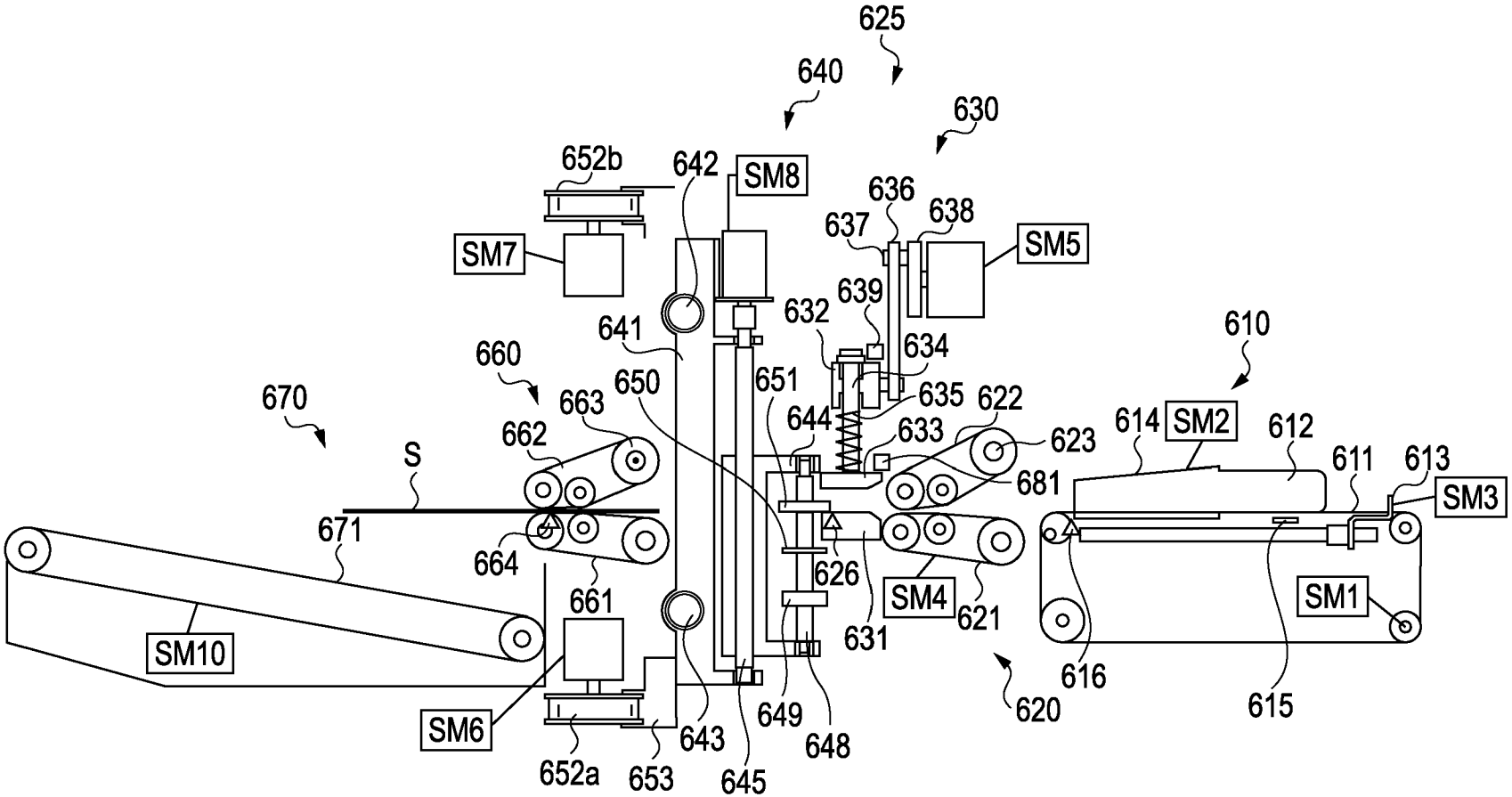
Figure 17A:
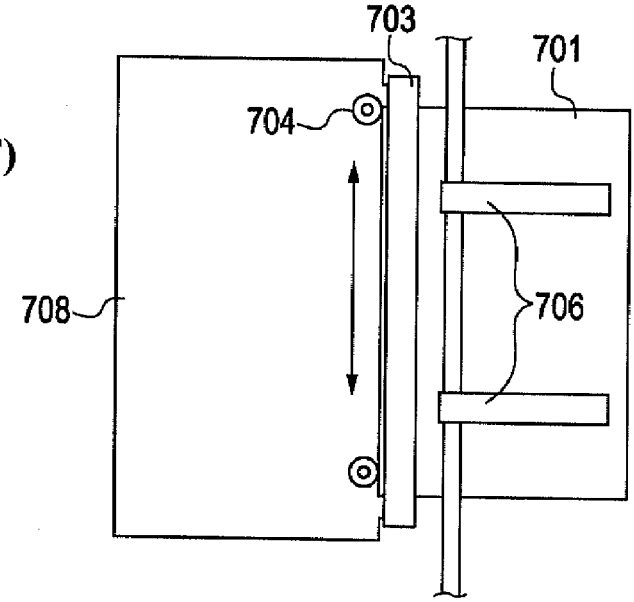
FIG. 17A (PRIOR ART)
FIGS. 17A to 17D schematically illustrate a squaring process performed by a sheet processing apparatus of related art.
Figure 17B:
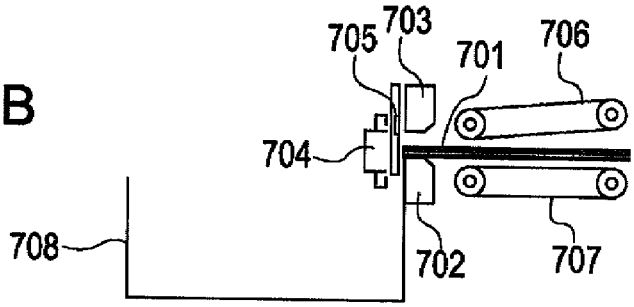
FIG. 17B (PRIOR ART)
Figure 17C:
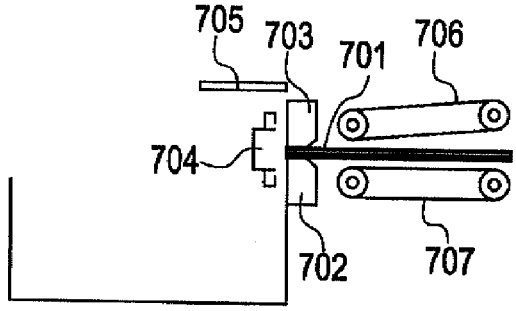
FIG. 17C (PRIOR ART)
Figure 17D:
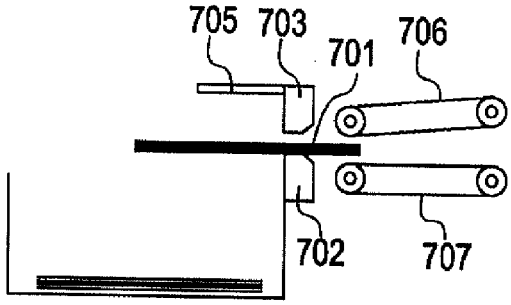
FIG. 17D (PRIOR ART)
Figure 18A:
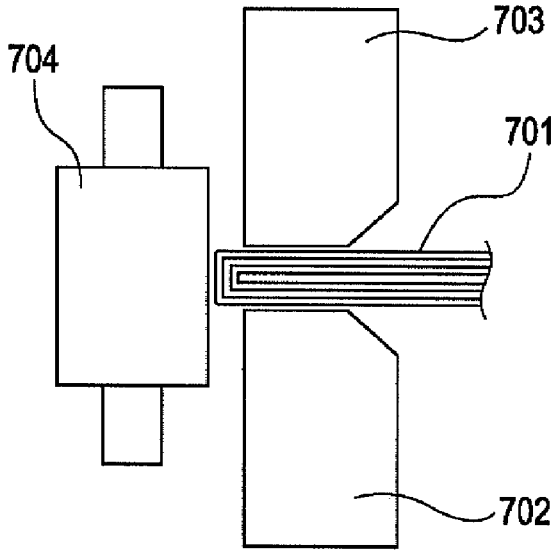
FIG. 18A (PRIOR ART)
FIGS. 18A and 18B show problems in the squaring process performed by the sheet processing apparatus of the related art.
Figure 18B:
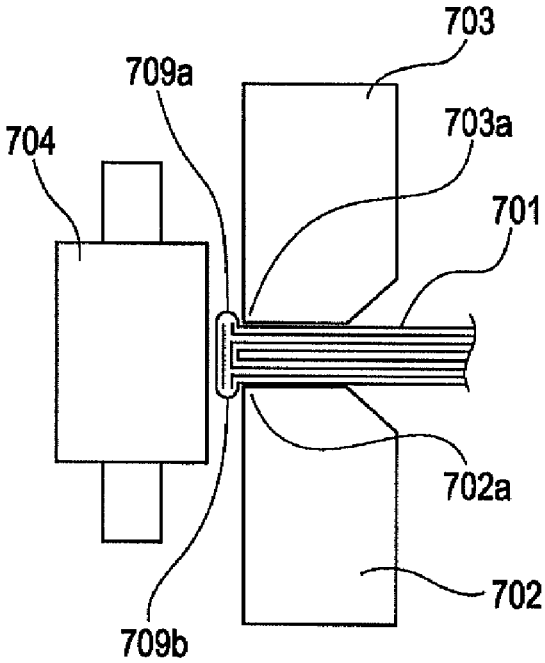
FIG. 18B (PRIOR ART)
Figure 19:
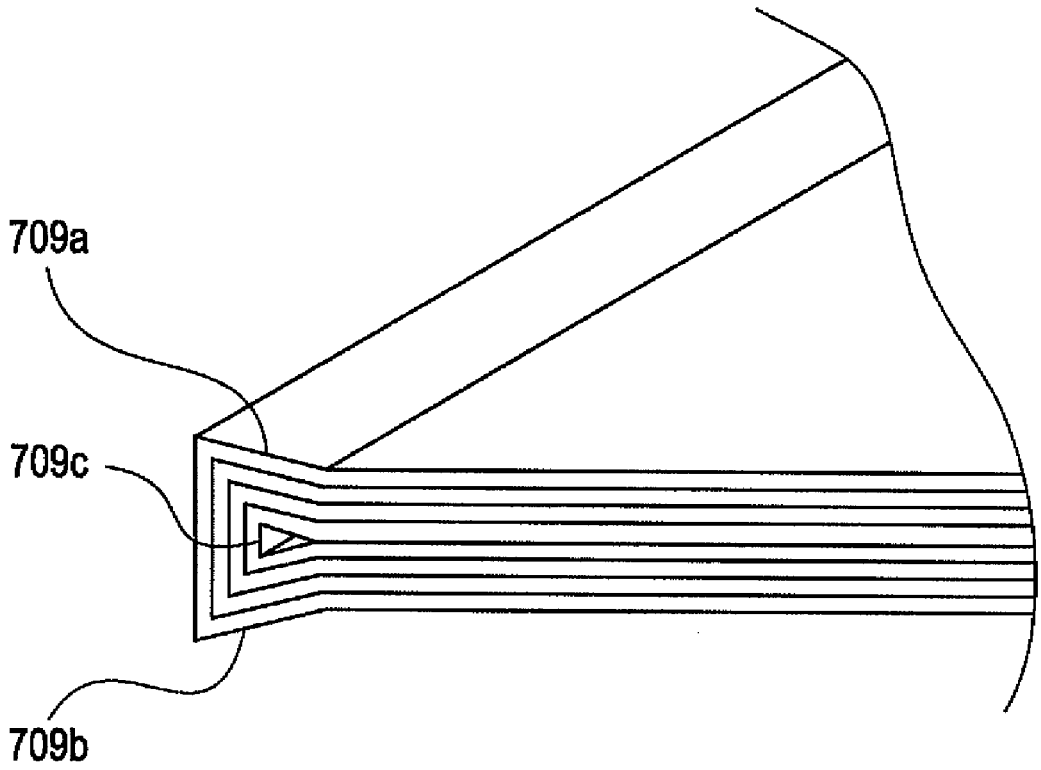
FIG. 19 (PRIOR ART)
FIG. 19 illustrates a booklet having undergone the squaring process performed by the sheet processing apparatus of the related art.

When the movement of the movable unit 656*a* is completed, the holding base 632 moves to the upper position in step S69, causing the lower and upper holding plates 631 and 633 to move away from each other. Subsequently, as shown in FIGS. 15C and 16B, the exit conveying portion 660 is driven by the driving motor SM4 in step S70, causing the exit conveying portion 660 to eject the booklet onto the conveyor tray 670. Then, when the booklet is detected to be in an ejected state by the ejection detection sensor 664 in step S71, the driving of the exit conveying portion 660 is stopped in step S72. Booklets ejected onto the conveyor tray 670 are sequentially stacked one on top of the other. In step S73, if an ejected booklet is not the last booklet, the operation returns to step S51, whereas if an ejected booklet is the last booklet, the job ends in step S74.

Although a booklet to be made in the saddle-binding portion 800 in the above embodiment is described as being a booklet made by half-folding a single sheet or up to 25 sheets as an example, the number of sheets can be changed depending on the performance of the saddle-binding portion 800.

Furthermore, although a booklet to be squared is described as being a booklet made by half-folding 11 or more sheets as an example, the number of sheets should not limit the present invention and may be changed in accordance with the basis weight or the thickness of the medium.

Although a squaring process is implemented by switching between pressing members with two kinds of heights (pressing widths) and different diameters depending on the thickness of a booklet to be squared in the above description, three or more kinds of pressing members with even more various dimensional features may be used.

Furthermore, although the operation in the above embodiment is performed on a case-by-case basis by detecting the thickness of a booklet using a sensor, the operation may performed on a case-by-case basis in accordance with a condition for determining the thickness of the booklet, such as the basis weight of the medium, the thickness thereof, and the number of sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-063013 filed Mar. 16, 2009 and No.

2009-207096 filed Sep. 8, 2009, which are hereby incorporated by reference herein in their entirety.

What is claimed is:

1. A sheet processing apparatus comprising:

a holding unit, which holds a booklet made of a folded sheet and having a thickness when held by the holding unit, the holding unit having a pair of holding members that nips the booklet to form a gap between the pair of holding members, the gap being substantially the same size as the thickness of the booklet;

a pressing member which enters into the gap and comes into pressure contact with a folded spine of the booklet held by the holding unit so as to deform the folded spine, wherein the pair of holding members regulates a deformation of the folded spine so as not to exceed the thickness of the booklet held by the pair of holding members when the folded spine is deformed by the pressing member.

2. The sheet processing apparatus according to claim 1, wherein the pair of holding members includes regulating surfaces that are parallel to each other.

3. The sheet processing apparatus according to claim 2, wherein the regulating surfaces extend continuously from holding surfaces of the pair of holding members to hold the booklet.

4. The sheet processing apparatus according to claim 1, wherein the pressing member is a roller that moves along the folded spine of the booklet held by the holding unit.

5. The sheet processing apparatus according to claim 1, further comprising:

a positioning member that positions the booklet by allowing the folded spine of the booklet to abut thereon, wherein the holding unit holds the booklet positioned by the positioning member, and the pressing member deforms the folded spine of the booklet held by the holding unit.

6. The sheet processing apparatus according to claim 1, further comprising a folding unit that folds the sheet, wherein the pressing member deforms the folded spine of the booklet made of the sheet folded by the folding unit.

7. An image forming apparatus comprising:

an image forming portion that forms an image on a sheet; and a sheet processing apparatus that processes the sheet having the image formed thereon, wherein the sheet processing apparatus includes:

a holding unit, which holds a booklet made of a folded sheet and having a thickness, the holding unit having a pair of holding members that nips the booklet to form a gap between the pair of holding members, the gap being substantially the same size as the thickness of the booklet;

a pressing member which enters into the gap and comes into pressure contact with a folded spine of the booklet held by the holding unit so as to deform the folded spine, the pair of holding members regulates a deformation of the folded spine so as not to exceed the thickness of the booklet held by the pair of holding members when the folded spine is deformed by the pressing member.

8. The image forming apparatus according to claim 7, wherein the pair of holding members includes regulating surfaces that are parallel to each other.

9. The image forming apparatus according to claim 8, wherein the regulating surfaces extend continuously from holding surfaces of the pair of holding members to hold the booklet.

10. The image forming apparatus according to claim 7, wherein the pressing member is a roller that moves along the folded spine of the booklet held by the holding unit.

11. The image forming apparatus according to claim 7, wherein the sheet processing apparatus further comprising:

a positioning member that positions the booklet by allowing the folded spine of the booklet to abut thereon, wherein the holding unit holds the booklet positioned by the positioning member, and the pressing member deforms the folded spine of the booklet held by the holding unit.

12. The image forming apparatus according to claim 7, wherein the sheet processing apparatus further comprising a folding unit that folds the sheet, wherein the pressing member deforms the folded spine of the booklet made of the sheet folded by the folding unit.

13. A sheet processing apparatus comprising:

a pair of holding members, configured to hold a booklet made of a folded sheet and having a thickness when held by the pair of holding members, the holding members nipping the booklet having the thickness to form a gap between the pair of holding members, the gap being substantially the same size as the thickness of the booklet;

a pressing member which enters into the gap and comes into pressure contact with a folded spine of the booklet held by the holding unit so as to deform the folded spine; and a regulating portion of the pair of holding members configured to regulate a deformation of the folded spine so as not to exceed the thickness of the booklet held by the pair of holding members when the folded spine is deformed by the pressing member.

14. A sheet processing apparatus according to claim 13, wherein the folded spine is positioned in the gap and the pressing member enters the gap to contact the folded spine to deform the folded spine.

15. A sheet processing apparatus comprising:

two substantially planar regulating members configured to form a gap in a direction of a thickness of a booklet made of a folded sheet; and a pressing member configured to press a folded spine of the booklet at a pressing position, the pressing position being within a region defined by the two regulating members, wherein the two regulating members regulate a deformation of the folded spine so that a thickness of the folded spine in a direction of a thickness of the booklet does not exceed the thickness of the booklet.

16. The sheet processing apparatus according to claim 15, wherein the two regulating members regulate the deformation of the folded spine by contacting the folded spine for prohibiting the thickness of the folded spine from exceeding the thickness of the booklet.

17. The sheet processing apparatus according to claim 15, wherein the pressing member presses the folded spine to form a pressed surface along a direction of a length of the folded spine, and the pressing position where the pressed surface is formed along the direction of the length of the folded spine is within the region defined by the two regulating members.

* * * * *